US009180575B1

(12) United States Patent
Dzigava

(10) Patent No.: US 9,180,575 B1
(45) Date of Patent: Nov. 10, 2015

(54) SYSTEMS AND METHODS FOR CONSTRUCTING MOSAIC WOOD FLOORING PANELS AND/OR MORE COMPLEX MOSAIC WOOD STRUCTURES

(76) Inventor: Paata Dzigava, Brooklyn, NY (US)

( * ) Notice: Subject to any disclaimer, the term of this patent is extended or adjusted under 35 U.S.C. 154(b) by 806 days.

(21) Appl. No.: 13/288,413

(22) Filed: Nov. 3, 2011

Related U.S. Application Data

(60) Provisional application No. 61/414,093, filed on Nov. 16, 2010.

(51) Int. Cl.
*B25B 5/08* (2006.01)

(52) U.S. Cl.
CPC ..... *B25B 5/08* (2013.01)

(58) Field of Classification Search
CPC ..... B25B 1/20; B25B 5/06; B25B 5/067; E04G 13/025; E04G 17/001
USPC ..... 269/43, 111, 122, 217, 246, 247, 250
See application file for complete search history.

(56) References Cited

U.S. PATENT DOCUMENTS

| | | | | | |
|---|---|---|---|---|---|
| 196,906 | A | * | 11/1877 | Jebsen | 83/140 |
| 357,387 | A | * | 2/1887 | Houston | 269/110 |
| 459,380 | A | * | 9/1891 | Scott | 269/221 |
| 615,832 | A | | 12/1898 | Fields, Jr. | |
| 1,048,519 | A | * | 12/1912 | Fuhs | 269/165 |
| 1,099,055 | A | * | 6/1914 | Killits | 269/117 |
| 1,128,527 | A | * | 2/1915 | Russell | 269/107 |
| 1,140,632 | A | * | 5/1915 | Tracy | 269/122 |
| 1,214,905 | A | * | 2/1917 | Engstrom | 269/229 |
| 1,308,084 | A | * | 7/1919 | Lampert | 269/122 |
| 1,639,083 | A | * | 8/1927 | De Penning | 269/110 |
| 1,660,480 | A | | 2/1928 | Daniels | |
| 1,674,280 | A | * | 6/1928 | Eklof | 269/122 |
| 1,755,284 | A | * | 4/1930 | Colt | 269/122 |
| 1,756,583 | A | | 4/1930 | Cadwallader | |
| 1,773,390 | A | * | 8/1930 | Colt | 269/122 |
| 1,774,317 | A | * | 8/1930 | Colt | 269/122 |
| 1,795,586 | A | * | 3/1931 | Willard | 269/122 |
| 2,014,841 | A | | 9/1935 | Heeren et al. | |
| 2,027,292 | A | | 1/1936 | Rockwell | |
| 2,049,571 | A | | 8/1936 | Schuck | |
| 2,054,015 | A | | 9/1936 | Bruce et al. | |
| 2,359,235 | A | * | 9/1944 | Miller | 269/148 |
| 2,518,112 | A | * | 8/1950 | Anthony | 269/126 |
| 2,575,798 | A | * | 11/1951 | Dain | 269/87.2 |
| 3,740,913 | A | | 6/1973 | Musser | |
| 3,815,890 | A | * | 6/1974 | Urban | 269/43 |
| 4,046,362 | A | * | 9/1977 | Spillers | 269/43 |
| 4,133,152 | A | | 1/1979 | Penrose | |
| 4,552,345 | A | * | 11/1985 | Benda et al. | 269/43 |
| 5,050,653 | A | | 9/1991 | Brown | |
| 5,207,252 | A | * | 5/1993 | Risse | 144/84 |

(Continued)

FOREIGN PATENT DOCUMENTS

JP 2006241727 9/2006

*Primary Examiner* — Lee D Wilson
*Assistant Examiner* — Jamal Daniel
(74) *Attorney, Agent, or Firm* — Amster, Rothstein & Ebenstein

(57) ABSTRACT

The invention generally relates to systems and methods for constructing flooring constructed from a plurality of pieces such that the flooring can include a mosaic pattern. Further, the systems and methods also can be used to produce more complex mosaic structures constructed from at least one mosaic flooring panel. The mosaic flooring panels can be constructed of solid wood and/or other materials.

10 Claims, 33 Drawing Sheets

(56) References Cited

U.S. PATENT DOCUMENTS

| | | | | |
|---|---|---|---|---|
| 5,466,089 | A | 11/1995 | Jurik | |
| 5,813,186 | A | 9/1998 | Acksel | |
| 5,834,081 | A | 11/1998 | Fanti | |
| 6,189,283 | B1 | 2/2001 | Bentley | |
| 6,244,581 | B1 * | 6/2001 | Arnhold | 269/43 |
| 6,446,405 | B1 | 9/2002 | Pervan | |
| 6,584,747 | B2 | 7/2003 | Kettler | |
| 6,659,097 | B1 | 12/2003 | Houston | |
| 6,925,764 | B2 | 8/2005 | Hrovath | |
| 7,021,304 | B1 | 4/2006 | Houston | |
| 7,552,568 | B2 | 6/2009 | Palsson | |
| 7,877,956 | B2 | 2/2011 | Martensson | |
| 7,909,315 | B2 * | 3/2011 | Hill | 269/118 |
| 2001/0015042 | A1 | 8/2001 | Ballard | |
| 2001/0033771 | A1 | 10/2001 | Schmitz | |
| 2006/0032168 | A1 | 2/2006 | Thiers | |
| 2006/0197269 | A1 * | 9/2006 | Downey et al. | 269/111 |
| 2007/0175143 | A1 | 8/2007 | Pervan | |
| 2008/0041007 | A1 | 2/2008 | Pervan | |
| 2010/0212245 | A1 | 8/2010 | Tebo | |

* cited by examiner

SYSTEMS AND METHODS FOR CONSTRUCTING MOSAIC WOOD FLOORING PANELS AND/OR MORE COMPLEX MOSAIC WOOD STRUCTURES

CROSS-REFERENCE TO RELATED APPLICATIONS

This application claims priority to U.S. Provisional Patent Application No. 61/414,903, filed Nov. 16, 2010, the content of which is incorporated herein by reference in its entirety.

FIELD

The present disclosure generally relates to systems and methods that can be used to construct mosaic flooring panels from a plurality of pieces and/or more complex mosaic structures.

SUMMARY

In exemplary embodiments, a method for creating mosaic floor panels can comprise providing a flooring-wedge retainer that can comprise: (a) a base structure, (b) a base connector, (c) a wedge interfacer, and/or (d) a flooring interfacer; providing a wedge device that can comprise: (a) a base connector region, (b) a threaded rod, and (c) a wedge body; inserting a plurality of flooring pieces in the flooring-wedge retainer, wherein the plurality of flooring pieces can be adhesively affixed together to form a mosaic flooring panel; and/or inserting a pattern board and/or the wedge device in the flooring-wedge retainer, wherein the wedge device can be located between the pattern board and/or the wedge interfacer such that the wedge body can be capable of translating in a first direction and/or a second direction, and/or wherein the pattern board can be located between the wedge body and/or the plurality of flooring pieces such that the pattern board can be capable of translating in the first direction. Further, in exemplary embodiments, the plurality of flooring pieces, that may be adhesively affixed together, can be forcibly held together by translating the wedge body of the wedge device in the first direction and/or the second direction by, for example, rotating the threaded rod of the wedge device, thereby driving the pattern board in the first direction such that force can be applied on the plurality of flooring pieces, that may be adhesively affixed together; and/or pressing the plurality of flooring pieces, that may be forcibly held together and/or adhesively affixed together, in a hot press.

In exemplary embodiments, the pattern board can be a wood slat.

In exemplary embodiments, the method can further comprise inserting a wood slat in the flooring-wedge retainer between the flooring interfacer and/or the plurality of flooring pieces before inserting the plurality of flooring pieces in the flooring-wedge retainer.

In exemplary embodiments, the pattern board and/or the flooring interfacer may be parallel to each other and/or the wedge interfacer can be at an angle to both the flooring interfacer and/or the pattern board. Further, in exemplary embodiments, the wedge interfacer can be at about a 5 degree angle from the flooring interfacer and/or the pattern board.

In exemplary embodiments, driving the pattern board in the first direction can reduce the distance between the pattern board and/or the flooring interfacer.

In exemplary embodiments, when the threaded rod of the wedge device are rotated the wedge body can translate away from and/or towards the base connector. Further, in exemplary embodiments, the threaded rod can be rotated by a mechanical drill.

In exemplary embodiments, the wedge device can be constructed of a metal and/or the pattern board can be a wood slat.

In exemplary embodiments, the pattern board can comprise shaped structure.

In exemplary embodiments, the method can further comprise inserting at least one of a plurality of the wedge devices and/or the pattern boards in at least one flooring-wedge retainer and/or at least one hot press to, for example, create a complex mosaic structure.

In exemplary embodiments, a wedge style vice for creating flooring can comprise: a flooring-wedge retainer device that can comprise: (a) a base structure, (b) a base connector, (c) a wedge interfacer, (d) a flooring interfacer, and/or (e) a pattern board that can be capable of translating in a first direction, wherein the base connector, the wedge interfacer, and/or the flooring interfacer may be immovably affixed to the base structure of the flooring-wedge retainer. Further, in exemplary embodiments the wedge style vice for creating flooring can comprise: a wedge device that can comprise: (a) a base connector region, (b) a threaded rod, and/or (c) a wedge body that can be capable of translating in the first direction and/or a second direction. Also, in exemplary embodiments, the wedge body can comprise a first side contacting the wedge interfacer and/or a second side contacting the pattern board, the second side can be parallel to the pattern board and/or the flooring interfacer and/or the first side can be at an angle to the pattern board and/or the flooring interfacer; and/or the wedge device can be located between the wedge interfacer and/or the pattern board such that the pattern board and/or the flooring interfacer may be parallel to each other and/or the wedge interfacer may be at an angle to both the flooring interfacer and/or the pattern board. Further, in exemplary embodiments, the wedge body can translate in the first direction and/or the second direction such that translating the wedge body can drive the pattern board in a first direction that can be parallel to the flooring interfacer, thereby forcibly holding together a plurality of flooring pieces.

In exemplary embodiments, the pattern board can be a wood slat.

In exemplary embodiments, a wood slat can be inserted in the flooring-wedge retainer between the flooring interfacer and/or the plurality of flooring pieces before inserting the plurality of flooring pieces in the flooring-wedge retainer.

In exemplary embodiments, the wedge interfacer can be at about a 5 degree angle from the pattern board.

In exemplary embodiments, driving the pattern board in the first direction can reduce the distance between the pattern board and/or the flooring interfacer.

In exemplary embodiments, the threaded rod of the wedge device can be rotated such that the wedge body can translate at least one of away from and/or towards the base connector. Further, in exemplary embodiments, the threaded rod can be rotated by a mechanical drill.

In exemplary embodiments, the wedge device can be constructed of metal and/or the pattern board can be constructed of wood slat.

In exemplary embodiments, the pattern board can comprise a shaped structure.

In exemplary embodiments, a plurality of the wedge devices and/or the pattern boards in at least one flooring-wedge retainer and/or at least one hot press can be used to create a complex mosaic structure.

In exemplary embodiments, the plurality of flooring pieces may be glued together before being forcibly held.

BRIEF DESCRIPTION OF THE DRAWINGS

The features and advantages of the present disclosure will be more fully understood with reference to the following detailed description, when taken in conjunction with the accompanying figures, wherein.

DETAILED DESCRIPTION

Figure 1A:
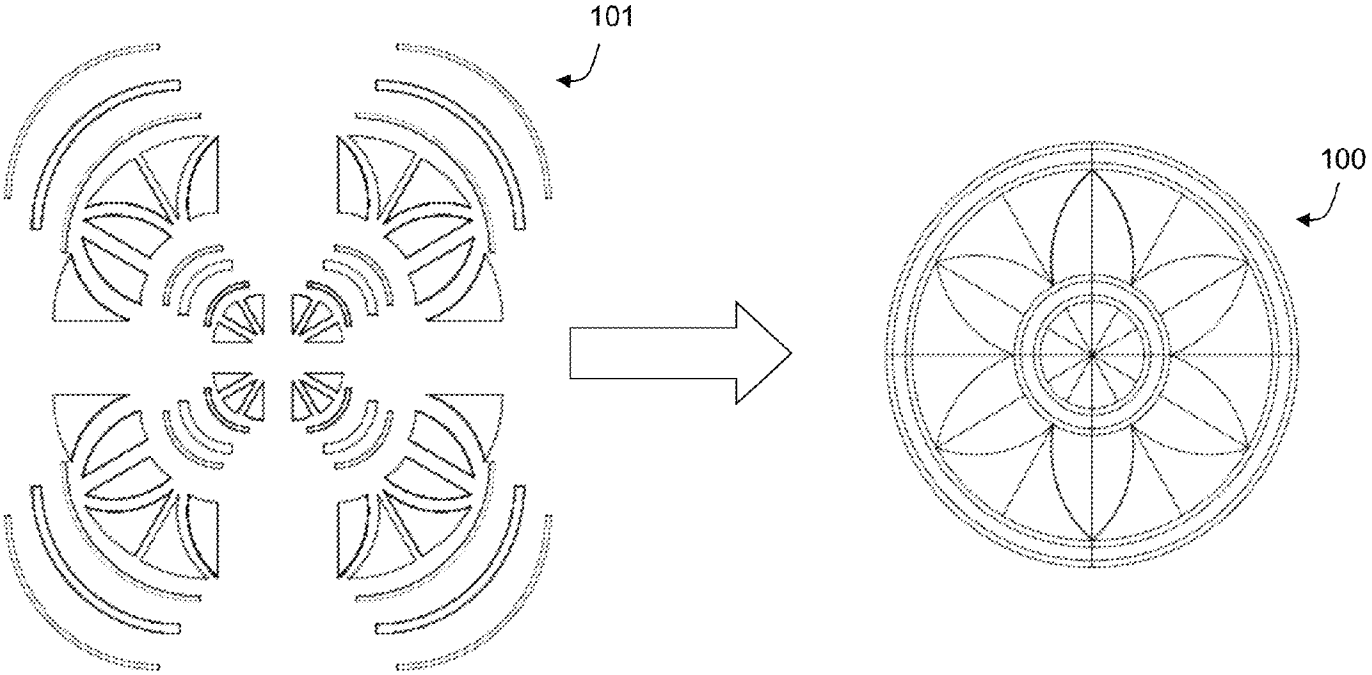
FIGS. 1A-1B illustratively depict exemplary mosaic flooring panels constructed from a plurality of pieces, in accordance with embodiments of the disclosure.

The invention generally relates to systems and methods for constructing flooring constructed from a plurality of pieces such that the flooring can include a mosaic pattern. Further, the systems and methods also can be used to produce more complex mosaic structures constructed from at least one mosaic flooring panel.

For ease, the terms mosaic flooring panel, wood flooring, and the like are, at times, used to describe wood flooring, mosaic flooring panels, planks, panels, and/or other structures. Further, for ease, more complex structures are, at times, described as being constructed from mosaic flooring panel, flooring, and the like. It will be understood that this language is in no way meant to limit the scope of the disclosure to wood flooring and/or flooring panels. Rather, this is merely for ease.

Further, pieces can be any reasonable wood type such as, but not limited to, oak, walnut, cherry, lime, pine, maple, mahogany, bamboo (although technically a grass), and tropical woods, to name a few and/or any other type of material such as, but not limited to, composites, polymers, plastics, and/or any further separation and/or combination thereof, to name a few.

In exemplary embodiments, generally speaking, the methods for constructing mosaic flooring panels can include obtaining a plurality of pieces, for example, wood pieces, having a desired shape, patterning the pieces, applying an adhesive to at least some region on at least one lateral side of at least one of the pieces, and applying force to at least one of the pieces such that the pieces are compressed into a mosaic pattern. Further, after patterning the pieces, pressure can be applied to the top and/or bottom of the pieces while compressive force is applied on the pieces. As this pressure is applied the compressive force can be adjusted. Also, at any point during construction thermal forces, such as, heat, can be applied to the pieces and/or adhesive. For example, the pieces and/or adhesive can be heated when under pressure and/or compression. After the adhesive has substantially cured the pressure and compressive force can be reduced and the constructed mosaic flooring panel constructed from the pieces can be obtained.

Further, in exemplary embodiments, generally speaking, the methods for constructing more complex mosaic structures from at least one mosaic flooring panel can include obtaining at least one mosaic flooring panel; modifying the shape of the obtained at least one mosaic flooring panel; patterning and applying an adhesive to at least some region on at least one lateral side of at least one of at least one mosaic flooring panel such that they form a more complex structure; and applying force to more complex structure. Further, after patterning more complex structure, pressure can be applied to the top and/or bottom of the more complex structure while compressive force is applied on the more complex structure. As this pressure is applied the compressive force can be adjusted. Also, at any point during construction thermal forces, such as, heat, can be applied to the more complex structure and/or adhesive. For example, the more complex structure and/or adhesive can be heated when under pressure and/or compression. After the adhesive has substantially cured, the pressure and compressive force can be reduced, and the more complex structure constructed from at least one mosaic flooring panel can be obtained.

This mosaic flooring panel and/or this mosaic pattern can be substantially identical on both the flooring's top and bottom surface. Further, these methods for constructing mosaic flooring panels can construct a mosaic flooring panel that may not require a base be adhered to it since, for example, it can be substantially sturdier than conventional mosaics. Further still, these methods for constructing mosaic flooring panels can construct a substantially monolithic mosaic flooring panel.

It will be understood that these mosaic designs can be used to construct ornamental parquet floors, flooring panels, panels, furniture, moldings, stairs, and balusters, to name a few. For ease, at times, only mosaic flooring panels are described. This is merely for ease and is in no way meant to be a limitation.

Figure 1B:
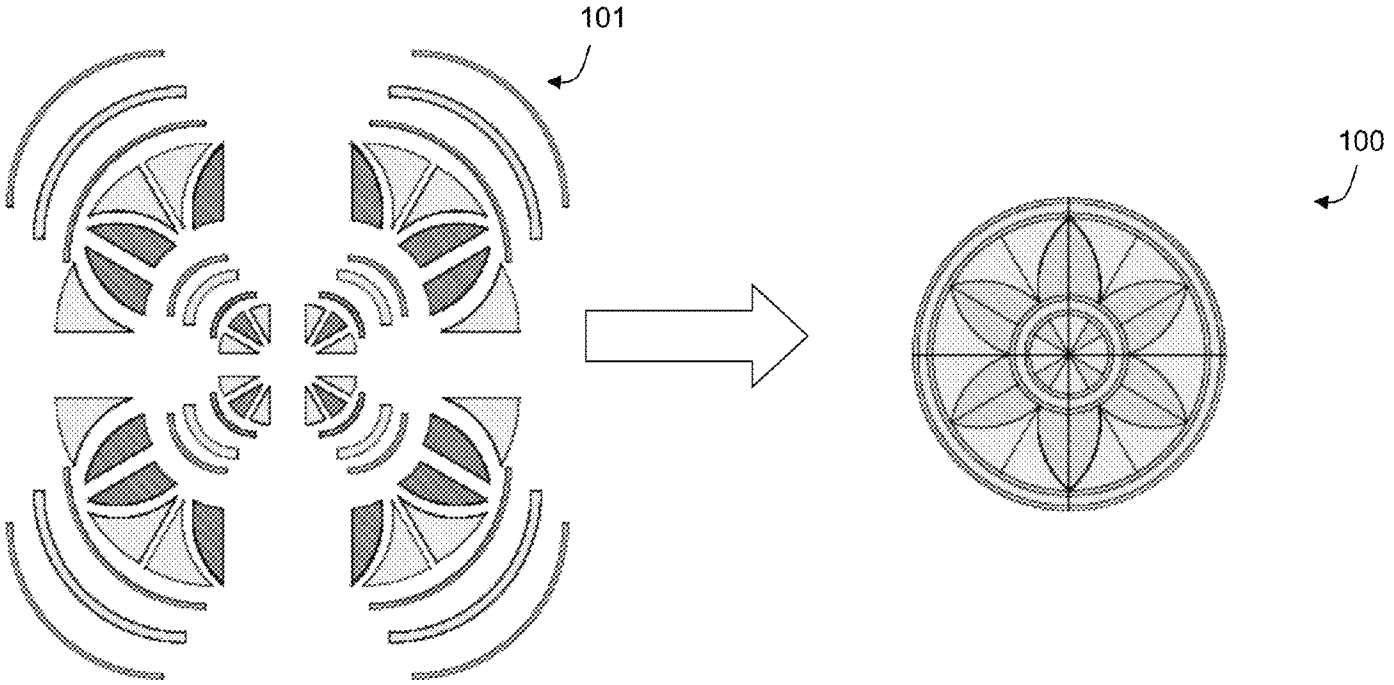

Referring to FIGS. 1A-1B, in exemplary embodiments, a mosaic flooring panel 100 can be constructed from a plurality of different pieces 101 that can each have different sizes, various angles, different shapes, and/or be different wood types. For example, the thickness of pieces 101 used to construct mosaic flooring panel 100 can range from about 0.5 inches to about 2.0 inches. Of course, larger or smaller thickness pieces 101 can be used without deviating from the scope of the disclosure. Also, in exemplary embodiments, mosaic flooring panel 100 can be up to about 48 inches to about 96 inches long. Of course, larger or smaller mosaic flooring panels 100 can be constructed without deviating from the scope of the disclosure.

Figure 2:
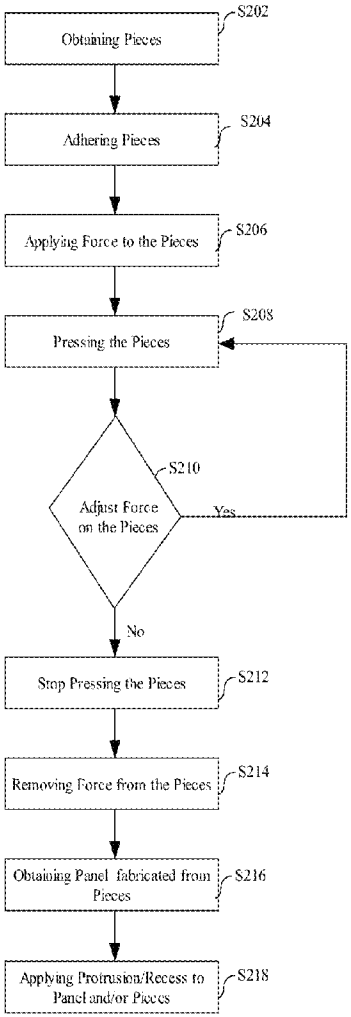
FIG. 2 is a flowchart illustrating a method for constructing mosaic flooring panels, in accordance with embodiments of the disclosure.

Referring to FIG. 2, in exemplary embodiments, methods for constructing mosaic flooring panels 100 can include numerous steps such as, but not limited to, the steps of obtaining, adhesively affixing, applying force on, and pressing a plurality of pieces 101. It will be understood that any of the steps described herein can be further added to, removed, occur in a different sequential order, be combined, and/or separated without deviating from the scope of the invention. For ease, at times, these steps are described as occurring sequentially and/or separately. This is merely for ease and is in no way meant to be a limitation.

Figure 3A:
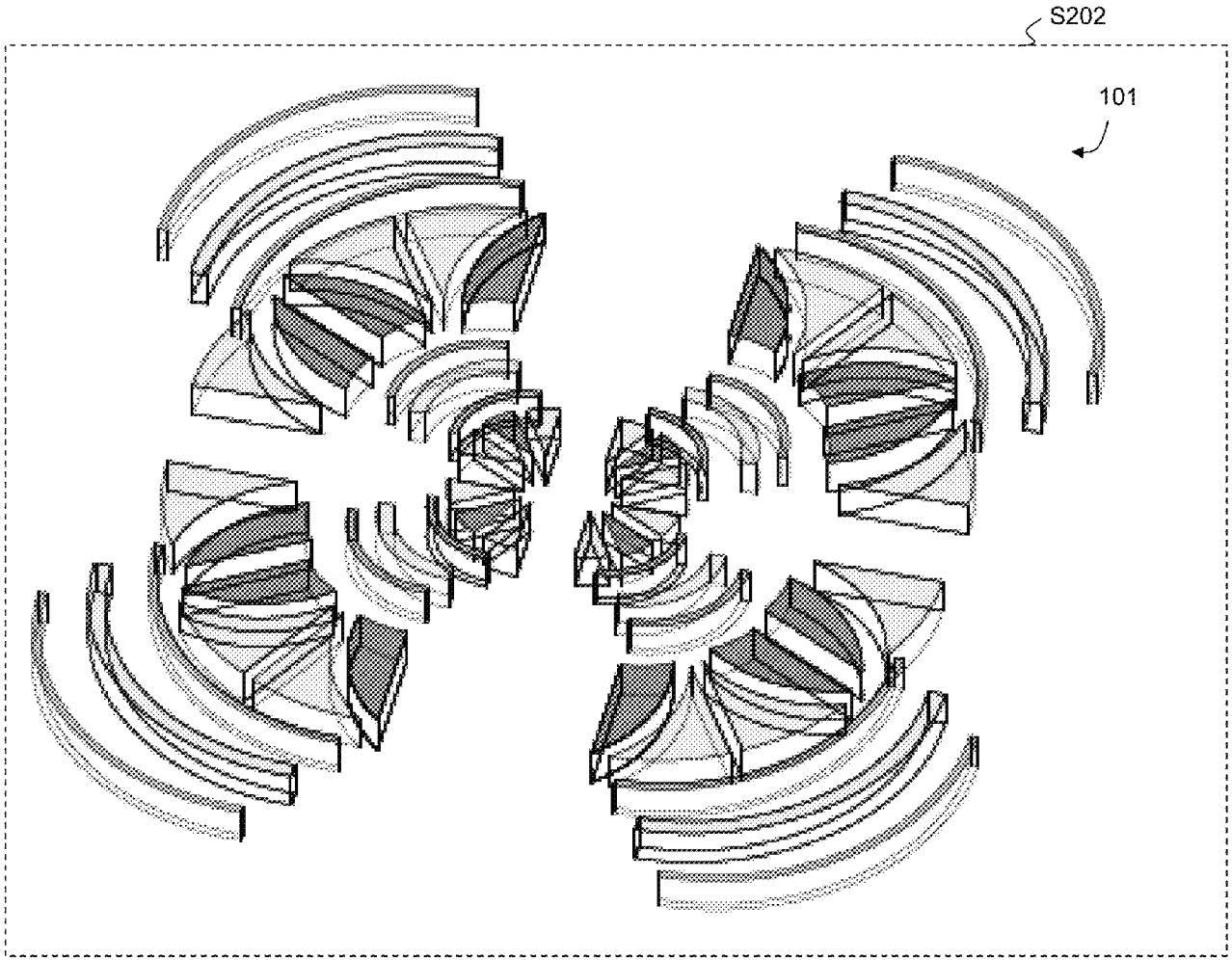
FIGS. 3A-3K illustratively depict various steps and/or variations thereof in the method for constructing mosaic flooring panels, in accordance with embodiments of the disclosure.

By way of example, at step 202, pieces 101 can be obtained from pre-cut pieces 101 and/or by cutting pieces 101. Further, the obtained pieces 101 can be arranged into a desired pattern. For example, pieces 101 can be arranged into a pattern on a main board. Referring to FIG. 3A, an exploded view of an exemplary mosaic pattern constructed from a plurality of pieces 101 is illustratively depicted. In exemplary embodiments, each of pieces 101 can include any number of lateral sides 300 (e.g., one side for a circular columnar element, two sides for a ellipsoidal columnar element, three sides for a triangular columnar element, four sides for a polygonal columnar element, etc.) such that they can be arranged, for example, on a main board (not shown) to construct a substantially monolithic mosaic flooring panel 100.

In exemplary embodiments, the mosaic flooring panels can be any fabricated from any material, composite, and/or any further combination and/or separation thereof, to name a few. For ease, the mosaic flooring panels are, at times, described as being fabricated from wood. This is merely for ease and is in no way meant to be a limitation.

These pieces 101 can be cut to a desired shape using any reasonable device for cutting wood, such as, but not limited to, $CO_2$ laser, neodymium (Nd) laser, neodymium yttrium-aluminum-garnet (Nd-YAG) laser, any other reasonable laser capable of cutting wood, hand saw, back saw, bow saw, circular saw, reciprocating saw, band saw, or any other reasonable saw capable of cutting wood, water jet cutter, air jet cutter, and steam jet cutter, to name a few.

Figure 3B:
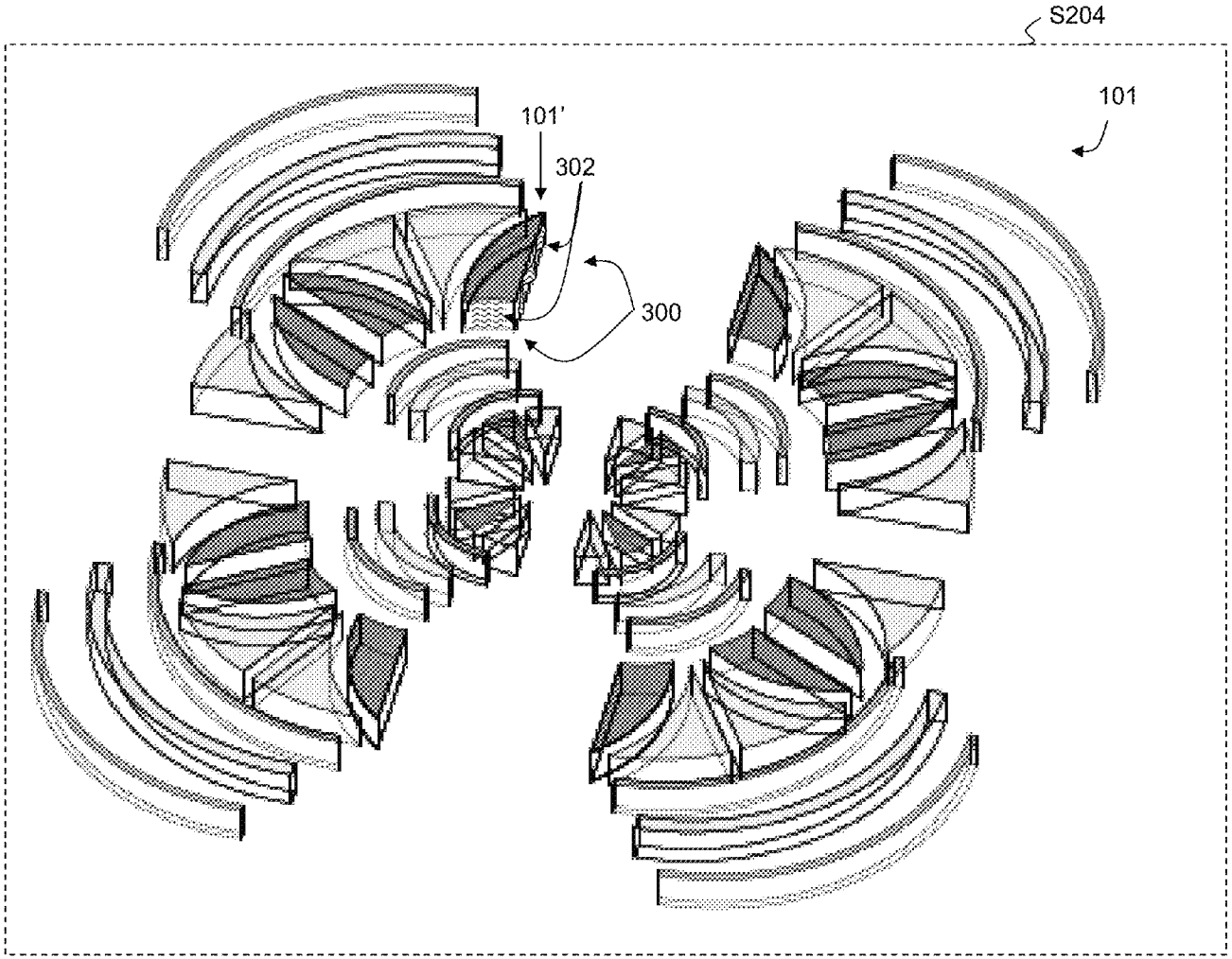

Referring back to FIG. 2, at step 204, adhesive can be applied to at least some of at least one of the lateral sides 300 of pieces 101. For example, referring to FIG. 3B, adhesive 302 can be applied on at least some of lateral sides 300 of pieces 101 that contact at least some of other lateral sides 300 of other pieces 101. In some instances, adhesive 302 need not be applied to all lateral sides 300 of pieces 101 that contact other lateral sides 300 of other pieces 101. For example, if two pieces of 101 are going to be adhered together on a lateral side than adhesive 302 can be applied on only one of the two pieces of wood's lateral sides. In some instances, adhesive 302 need not be applied to all lateral sides 300 of each of pieces 101. For example, adhesive 302 may not be applied to the outermost lateral sides 300 that form the eternal edge of mosaic flooring panel 100.

It will be understood that adhesive can be applied to at least some of at least one of the lateral sides 300 of pieces 101. For ease, referring to FIG. 3B adhesive 302 is illustratively depicted on two lateral sides 300 of a single piece 101'. This is merely for ease and is in no way meant to be a limitation.

It will be understood that adhesive 302 can be any reasonable adhesive such as, but not limited to, urea-formaldehyde, resorcinol, phenol formaldehyde resin, animal glues, polyvinyl acetate, polyurethane glue, epoxy, cyanoacrylate, contact cement, hot melt, hot bitumen, and cold adhesives, to name a few. By way of example, adhesive 302 can be Titebond® Original Wood Glue.

Figure 3C:
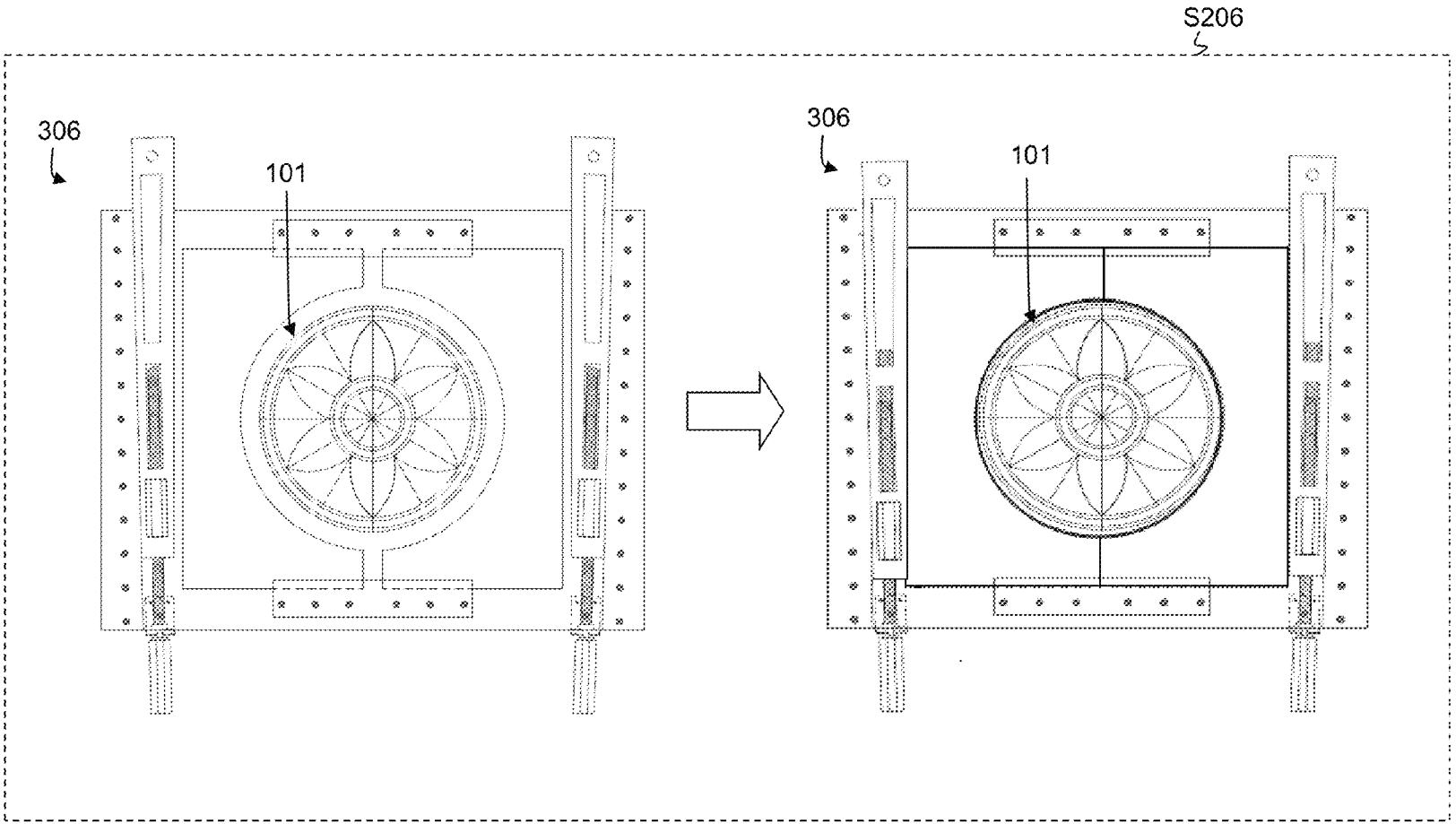

Referring back to FIG. 2, at step 206, force can be applied on the pieces 101 such that pieces 101 can be compressed. This compressive force can result in a substantially single mosaic design. For example, force can be applied on the outermost lateral surface of the mosaic design such that each of pieces 101 are compressed. Further, in exemplary embodiments, this force can be applied equally on the laterally surface of at least some of the pieces 101. For example, referring to FIG. 3C, a flooring-wedge retainer system 306 that uses at least one wedge vice is illustratively depicted applying force on pieces 101 such that pieces 101 can be compressed into a single mosaic design.

It will be understood that this force can be applied using any reasonable vice/clamp such as, but not limited to a wedge vice, a band clamp or web clamp, bar clamp, F-clamp, sliding clamp, bench clamp, cardellini clamp, jaw-style clamp, C-clamp (also G-clamp), flooring cramp, gripe, handscrew, kant-twist clamp, magnetic clamp, mitre clamp, pipe clamp, sash clamp, set screw, speed clamp, toggle clamp, pinch dog, woodworker's bench vise, engineer's bench vise, machine vise, woodworker's vise, hand vise (hand-held vise), machine vise, compound slide vise, cross vise, off-center vise, angle vise, sine vise, rotary vise, diemakers' vise, table vise, pin vise, jewelers' vise, and leg vise, any combination and/or plurality thereof, and/or any other device capable of applying force on the pieces 101 when in a press. Further, in exemplary embodiments, the system and/or device capable of applying force on the pieces 101 may be required to have a substantially flat top and/or bottom surface such that it can be used in a press.

For ease, at times, only flooring-wedge retainer system 306 using at least one wedge vice and/or other systems using any number of wedge vices is described for applying force on pieces 101. This is merely for ease and is in no way meant to be a limitation.

Figure 3D:
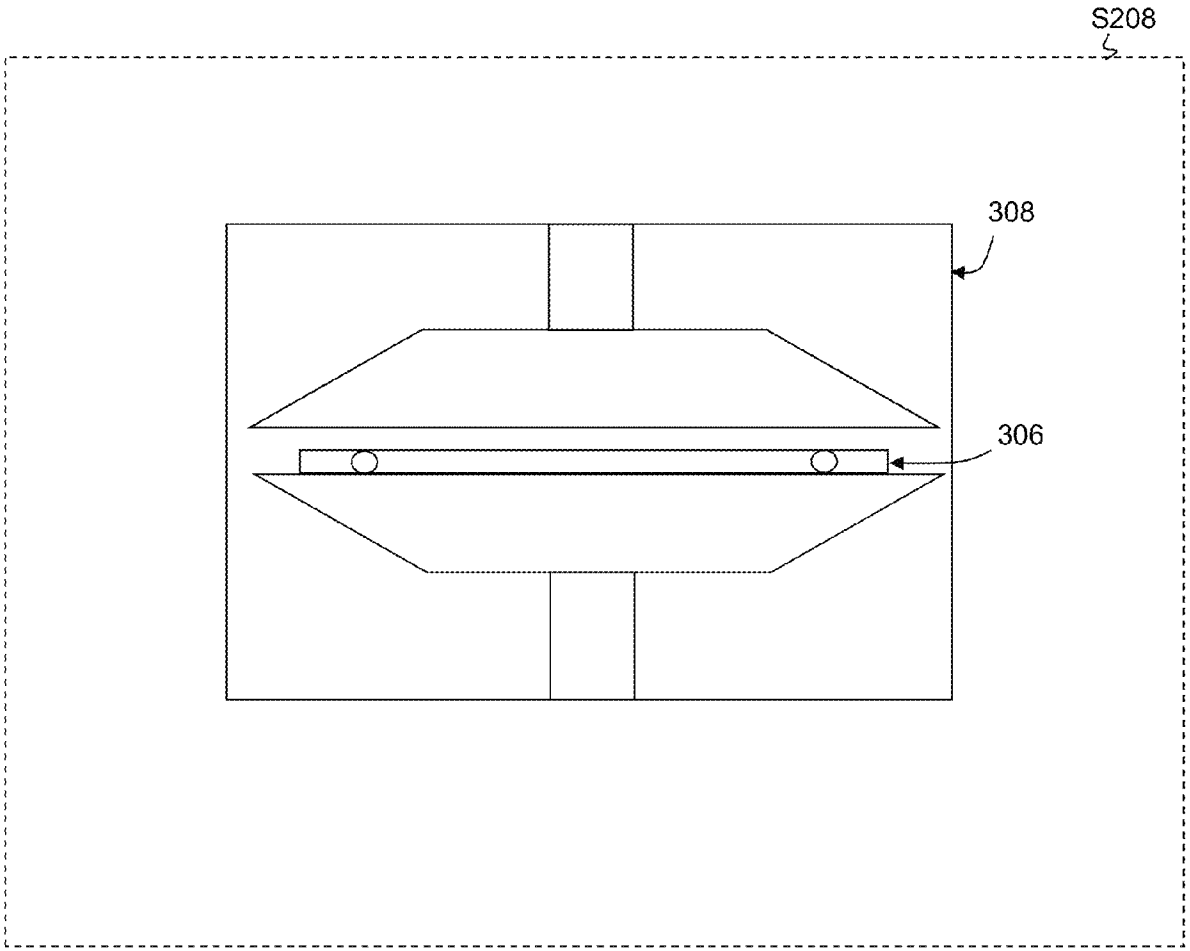
Figure 3E:
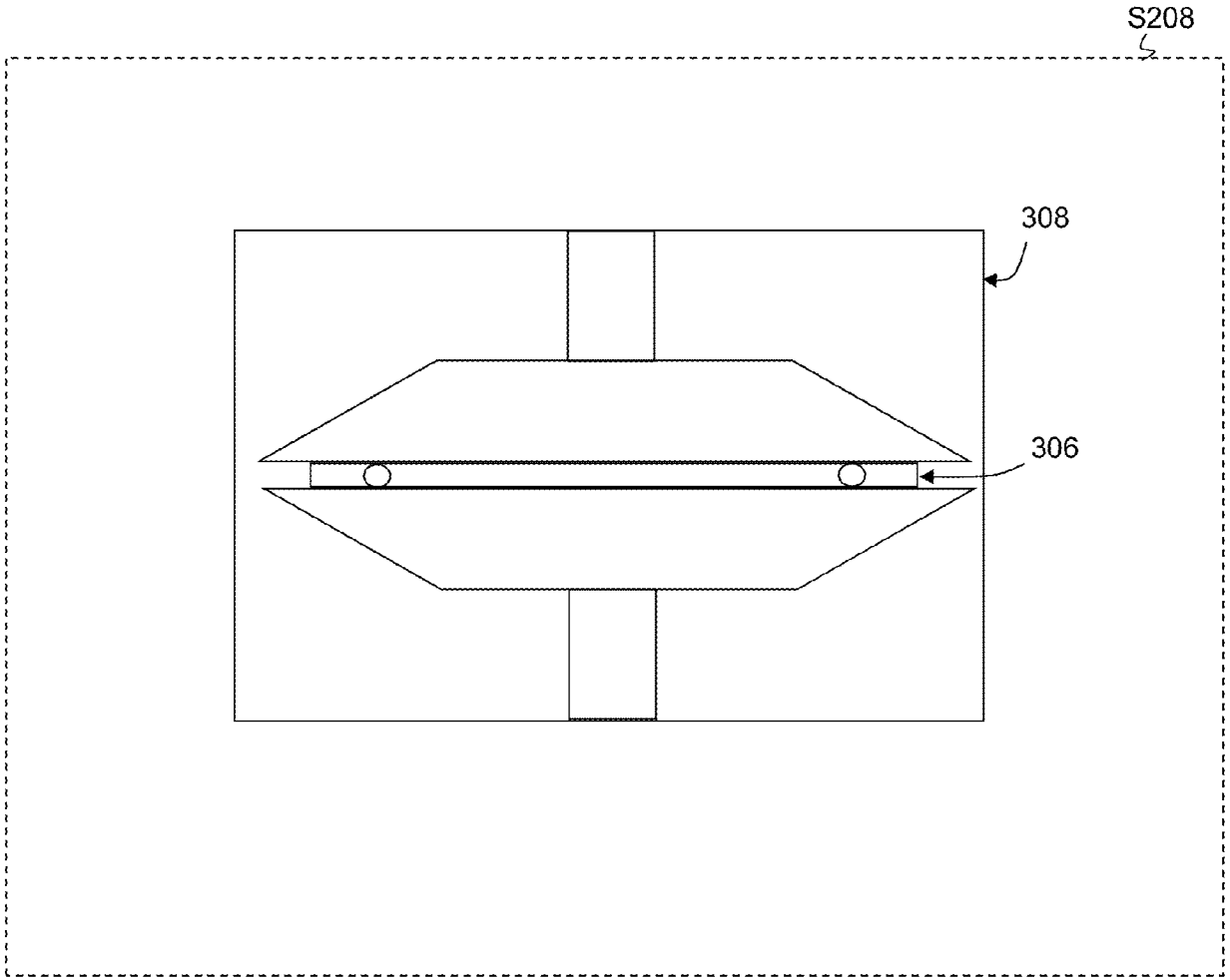

Referring back to FIG. 2, at step 208, flooring-wedge retainer system 306 housing and/or compressing pieces 101 can then be placed into a machine press 308 and pressed. For example, referring to FIG. 3D flooring-wedge retainer system 306 housing and/or compressing pieces 101 can be placed in machine press 308 and, referring to FIG. 3E, be pressed.

In exemplary embodiments, machine press 308 can be a hot press and/or a cold press. By way of another example, with adhesive 302 applied, flooring-wedge retainer system 306 housing and/or compressing pieces 101 can be immediately placed into machine press 308 where it can be pressed and/or the temperature can be high enough to cause adhesive 302 to melt and/or cure.

In exemplary embodiments, machine press 308 can be a hot press and/or a cold press. It will be understood that machine press 308 can be any reasonable hot press and/or cold press such as, but not limited to, a hand operated press, a pneumatic press, a hydraulic press, screw press, any combination there of, and/or any other press that can apply pressure on flooring-wedge retainer system 306 housing and/or compressing the pieces 101. By way of example, machine press 308 can be a Joos Junior Pneumatic hot press sold by Black Forest Machine Company.

By way of example, machine press 308 can be a hot press that heats flooring-wedge retainer system 306, pieces 101, and/or adhesive 302 to about 75-200 degrees Celsius and/or, more specifically, about 100-130 degrees Celsius.

Further, by way of example, machine press 308 can apply about 2-15 bars (about 29-218 pound per square inch) on flooring-wedge retainer system 306, pieces 101, and/or adhesive 302 and/or, more specifically, can apply about 6 bars (about 87 pound per square inch) on flooring-wedge retainer system 306, pieces 101, and/or adhesive 302.

Further still, in exemplary embodiments, with adhesive 302 applied, flooring-wedge retainer system 306 housing and/or compressing pieces 101 can be immediately placed into machine press 308 where it can be pressed and/or the temperature can be high enough to cause adhesive 302 to melt and/or cure. Also, in exemplary embodiments, with adhesive 302 applied, flooring-wedge retainer system 306 housing and/or compressing pieces 101 and after waiting a period of time, such as, about an hour, it can be placed into machine press 308 where it can be pressed and/or the temperature can be high enough to cause adhesive 302 to melt and/or cure.

Figure 3F:
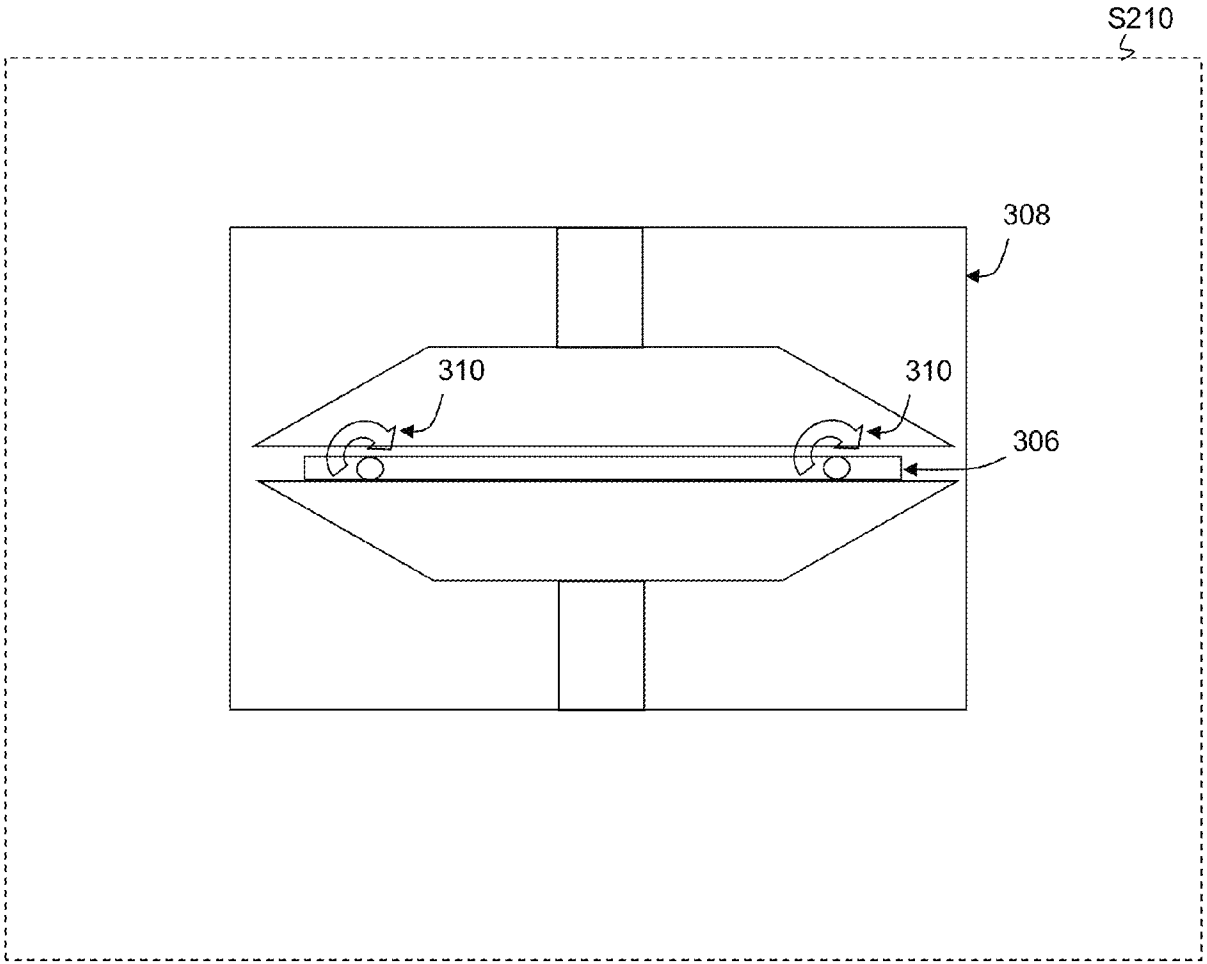
Figure 3G:
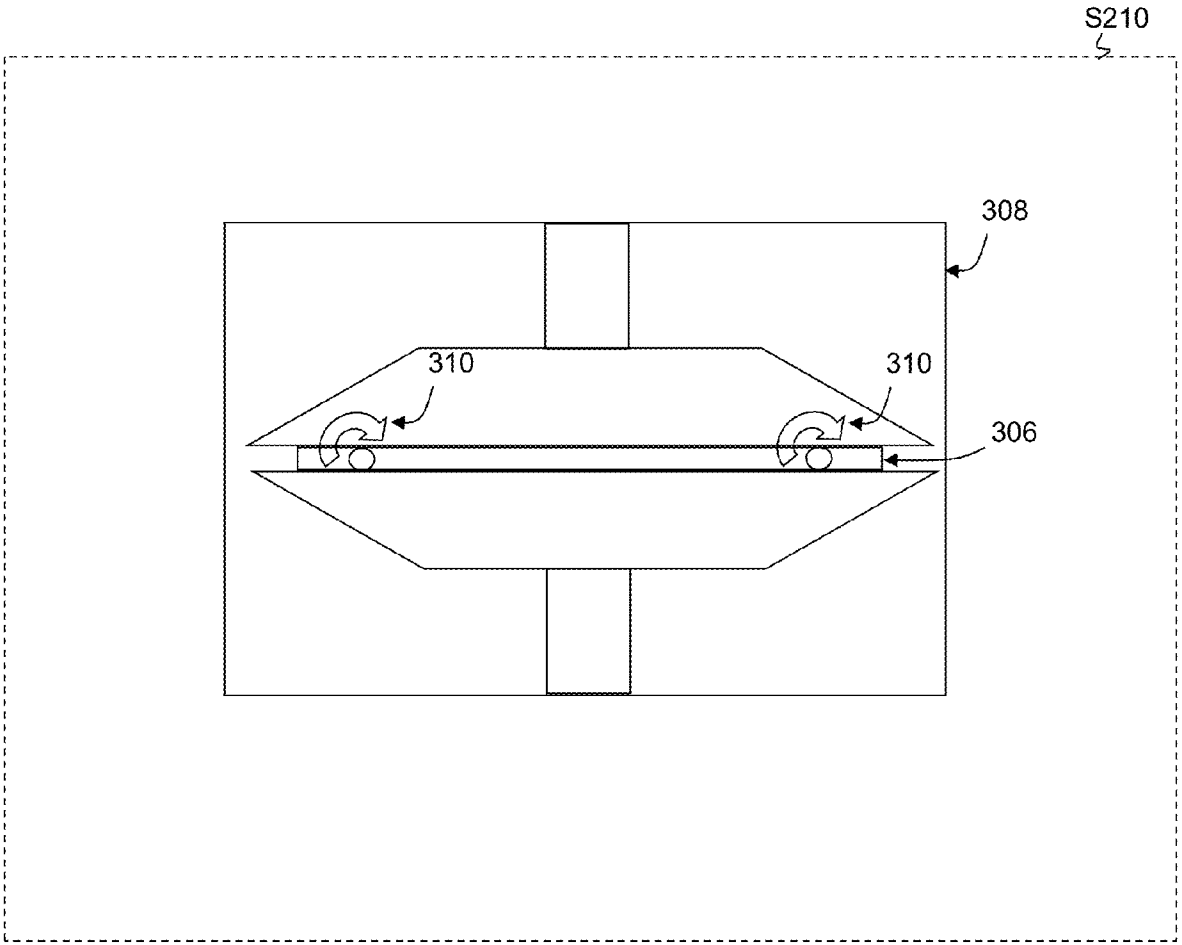

Referring back to FIG. 2, at decision step 210, while under the press, the force applied by flooring-wedge retainer system 306 can be adjusted. That is, while under the press completely and/or with at least some of the pressing force removed, a user can interface with flooring-wedge retainer system 306 to adjust the force compressing pieces 101. For example, referring to FIG. 3F-3G, rotating user interfaces 406 (described below in greater detail) associated with flooring-wedge retainer system 306 the force compressing pieces 101 can be adjusted while flooring-wedge retainer system 306 housing and/or compressing the pieces 101 are under the press.

As described below in greater details, this force can be adjusted to, for example, create more complex mosaic structures such as, for example, balusters, columns, and other more complex mosaic structures that can be, for example, constructed from a plurality of mosaic flooring panels 100 combined together.

Figure 3I:
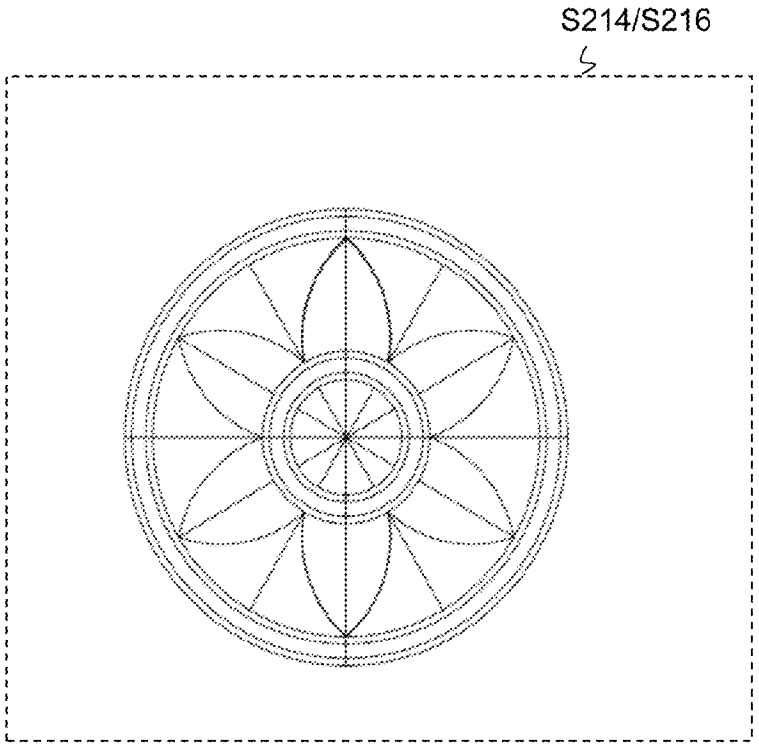
Figure 3H:
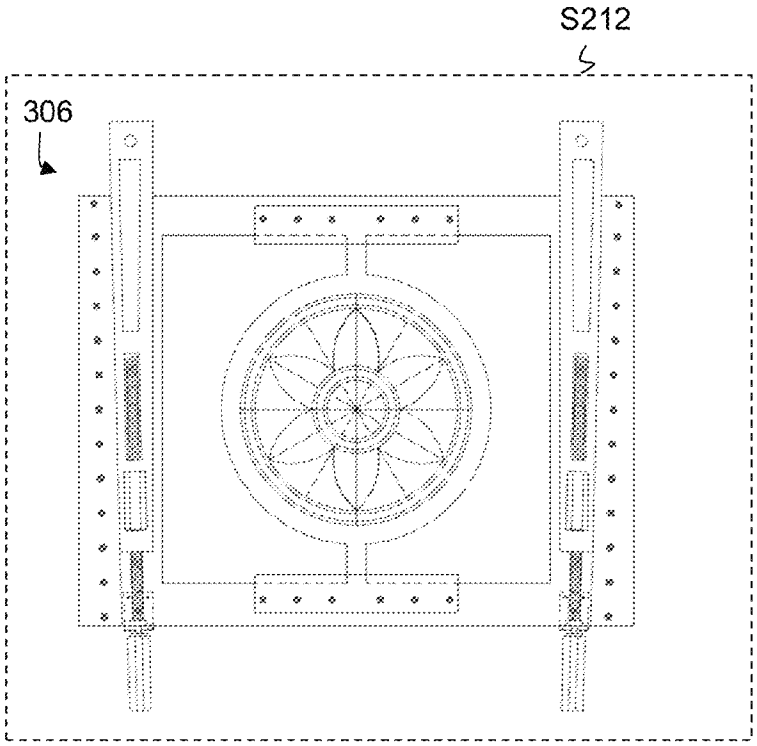

Referring back to FIG. 2 at step 212, the flooring-wedge retainer system 306 housing and/or compressing the pieces 101 can be removed from the press and, at step 214, force from flooring-wedge retainer system 306 that was compressing the pieces 101 can be released such that, at step 216, mosaic flooring panel 100 can be obtained. For example, referring to FIG. 3H-3I, flooring-wedge retainer system 306 housing and/or compressing the pieces 101 is illustrated after being removed from the hot press and the compressing force can be reduced such that mosaic flooring panel 100 is released from flooring-wedge retainer system 306.

Figure 3K:
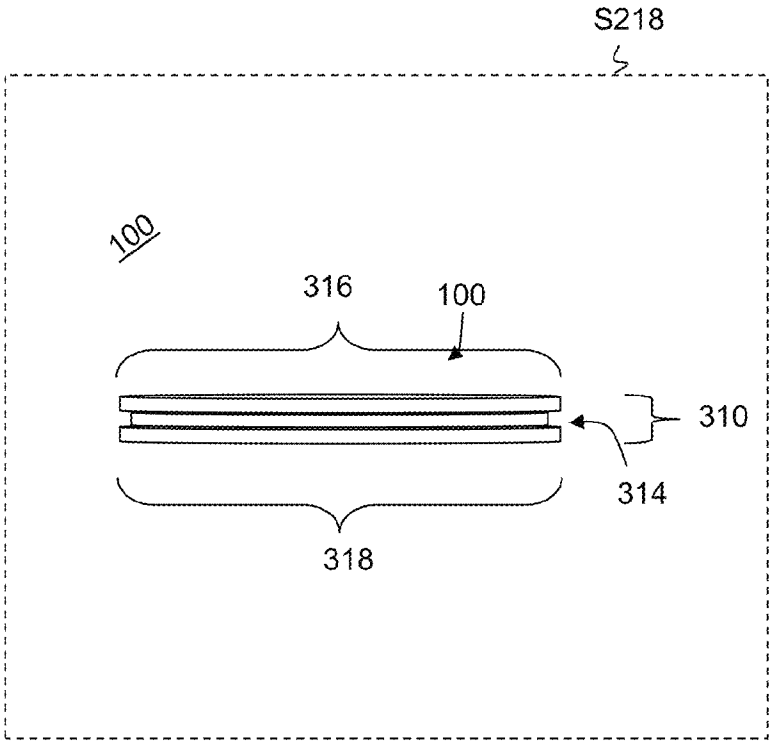
Figure 3J:
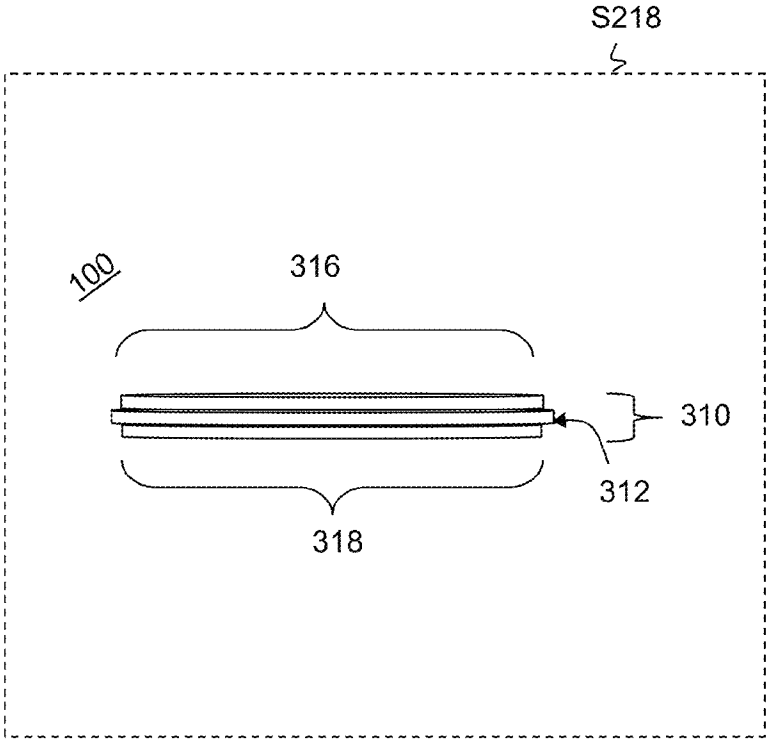

Referring back to FIG. 2 at step 218, in exemplary embodiments, mosaic flooring panel 100 can then have a protrusion and/or recess included on at least one outermost lateral side. For example, referring to FIGS. 3J-3K, on at least one of the outer most lateral side 310 at least one protrusion 312 and/or recess 314 can be included. These geometric protrusions and/or recesses can be designed to mate with another geometric protrusion and/or recess located on another lateral side of other objects such as other mosaic flooring panels.

In exemplary embodiments, mosaic flooring panel 100 can be substantially identical on its top surface 316 and bottom surface 318. For example, when viewed from its top surface 316 and bottom surface 318 substantially identical mosaics can be visible. These mosaics and/or pieces 101 can include any reasonable geometrical shape, such as, but not limited to squares, triangles, lozenges, herringbone, and/or any other shape.

Figure 4A:
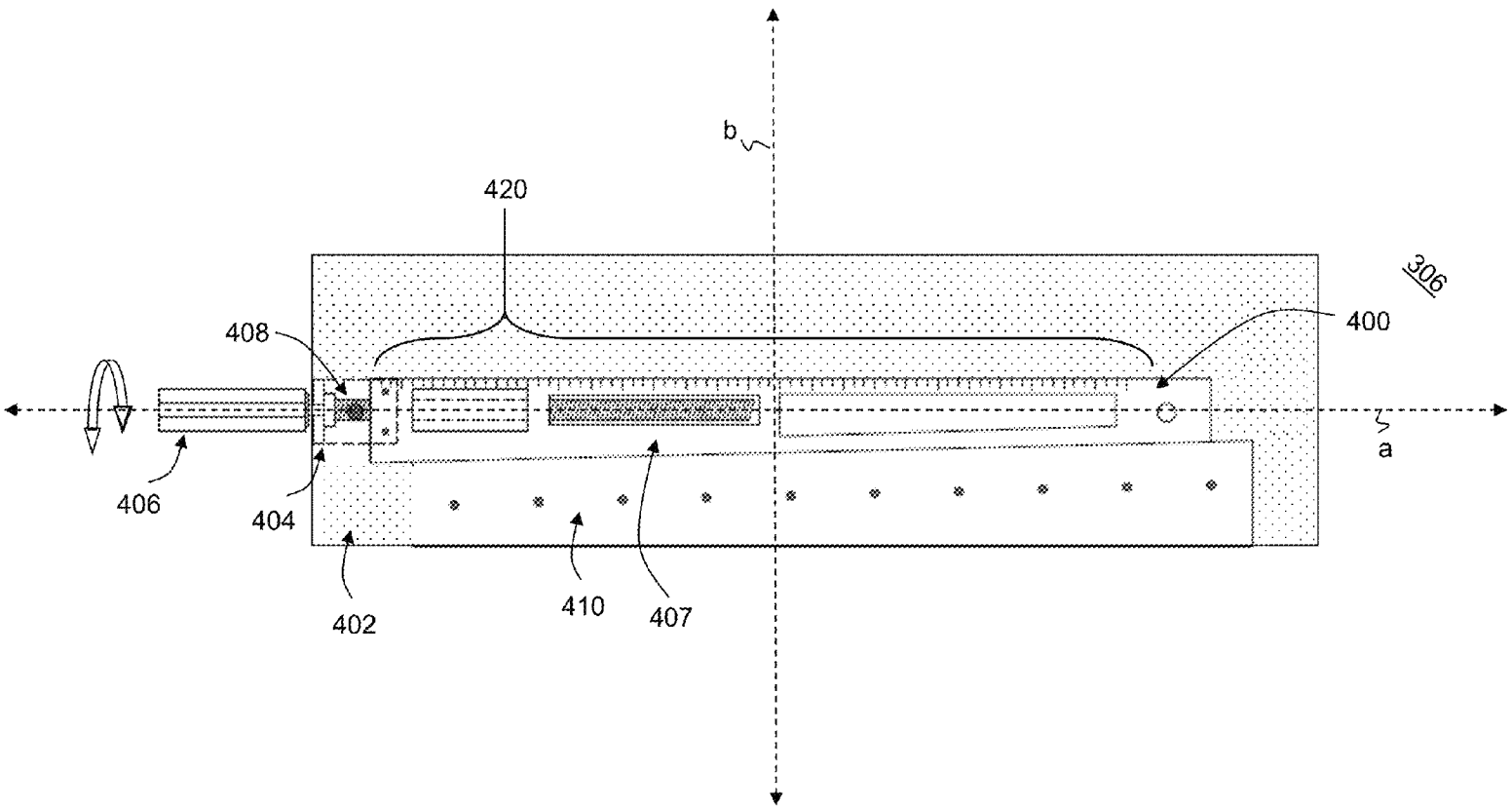
FIGS. 4A-4C illustratively depict exemplary wedge vice systems and/or exemplary methods of use thereof, in accordance with embodiments of the disclosure.

Referring to FIG. 4A, an exemplary flooring-wedge retainer system 306 is illustratively depicted including a wedge device 400 coupled and/or releasably coupled to a base structure 402, such as a main board, by a base connector 404 such that rotating a user interface 406 in turn rotates a threaded rod 408 thereby driving wedge body 407 of wedge device 400 along a first axis, axis a, and driving wedge body 407 of wedge device 400 along a second axis, axis b. Wedge body 407 of wedge device 400 can be driven along the second axis, axis b, due to interaction with a wedge interfacer 410, for example, a wedge interfacer, which can be substantially immobily coupled to base structure 402 of flooring-wedge retainer system 306. Further, wedge interfacer 410 and wedge body 407 of wedge device 400 can include at least one surface at an angle to each other and these surfaces can interact such that as wedge body 407 of wedge device 400 translates across the first axis, axis a, wedge body 407 of wedge device 400 is forced to translate across the second axis, axis b. Further, in exemplary embodiments, flooring-wedge retainer system 306 can include a scale 420. Scale 420 can be used to, inter alia, determine the quantity of translation of wedge body 407 of wedge device 400 and/or wedge device 400 with respect to wedge interfacer 410 and/or the quantity of force generated by translation of wedge body 407 of wedge device 400 and/or wedge device 400 with respect to wedge interfacer 410.

Figure 4B:
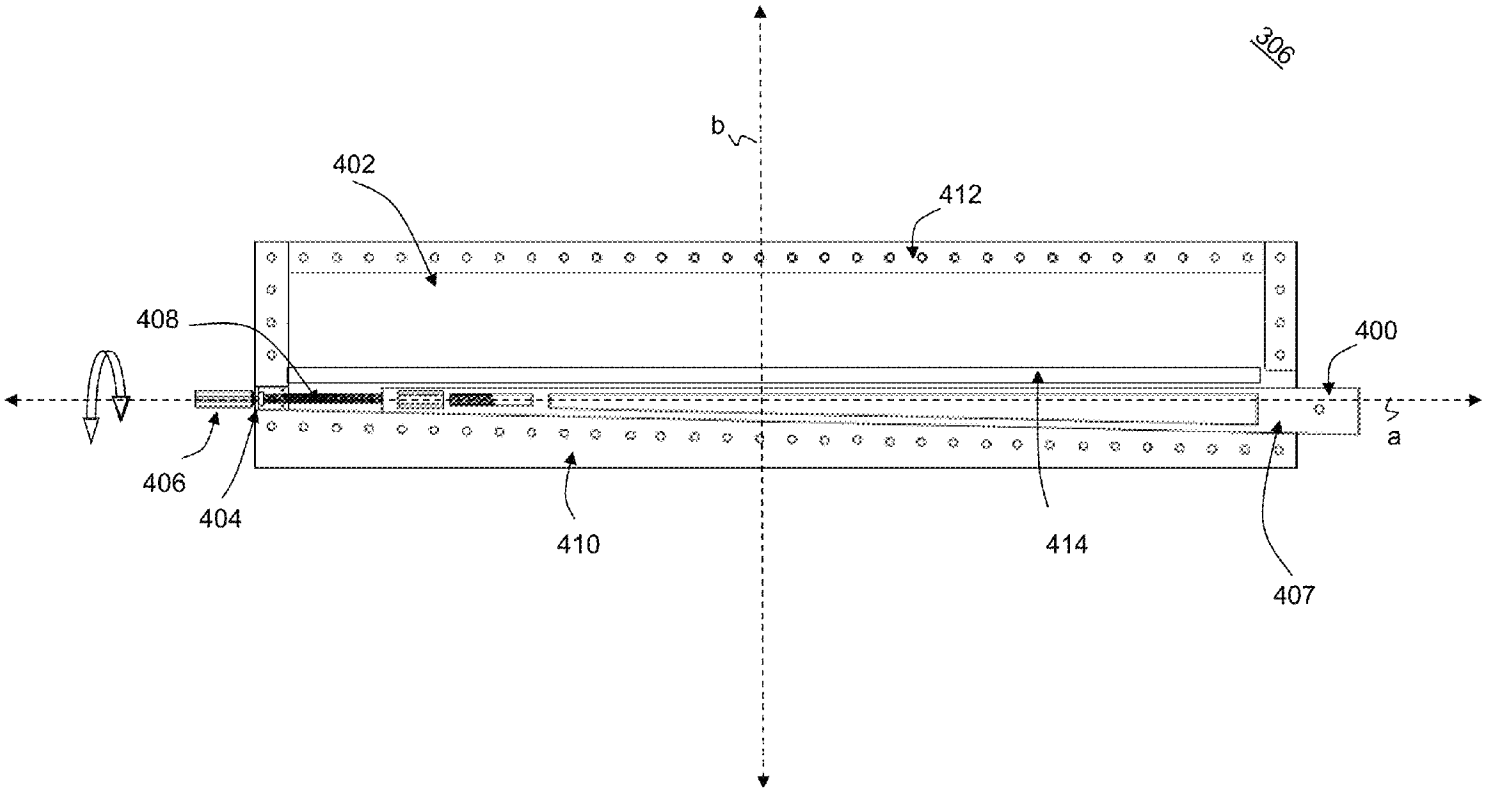
Figure 4C:
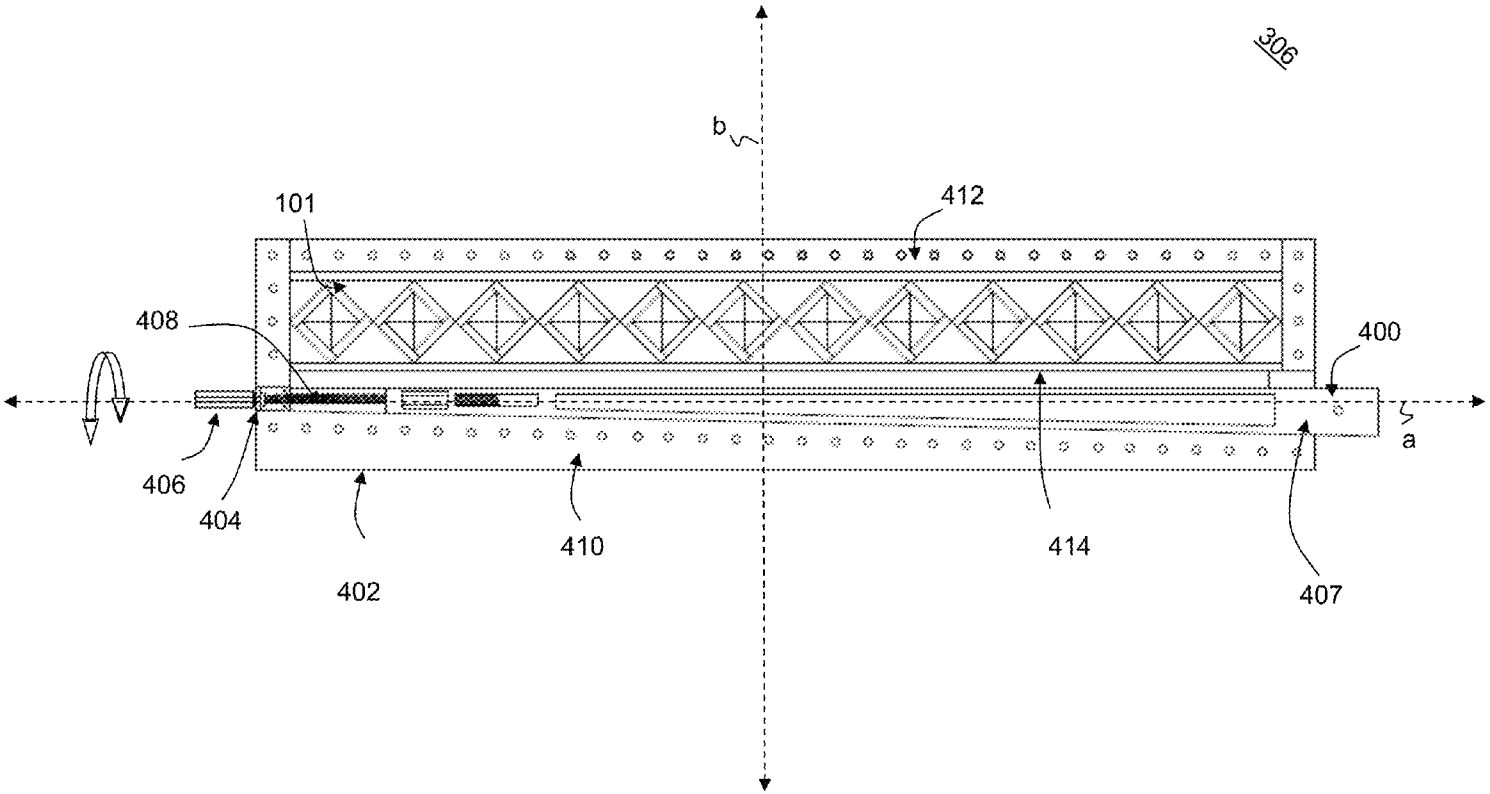

By way of example, referring to FIGS. 4B-4C, flooring-wedge retainer system 306 for creating mosaic flooring panels 100 can include a base structure 402, a base connector 404, a wedge interfacer 410, a flooring interfacer 412, and a pattern board 414 (e.g., a wood slat, wood fixture, etc.) capable of traversing second axis, axis b. Base connector 404, wedge interfacer 410, and/or flooring interfacer 412 can be immovably affixed to base structure 402. Further, wedge interfacer 410 and flooring interfacer 412 can be separated by a movable pattern board 414. Further, pattern board 414 and flooring interfacer 412 can be substantially parallel to each other. Also, wedge interfacer 410 can be at an angle to both flooring interfacer 412 and pattern board 414.

Base connector 404 can be affixed to base structure 402 such that a threaded rod 408 can be rotatably connected at one end to base connector 404 and/or base structure 402 and can also be rotatably connected along the length of wedge body 407 of wedge device 400. Wedge device 400 can have a first side contacting wedge interfacer 410 and a second side contacting pattern board 414. Further, the second side can be parallel to pattern board 414 and flooring interfacer 412 and/or the first side can be at an angle to pattern board 414 and flooring interfacer 412. Pattern board 414 can be driven in the second direction when wedge body 407 of wedge device 400 moves in the first direction, the second direction being substantially perpendicular to the first direction, and pattern board 414 can remain parallel to flooring interfacer 412 when driven in a second direction. This can cause a plurality pieces 101 to be forcibly compressed because when the wedge body 407 of wedge device 400 translates in the first direction it is forced in the second direction which in turn drives pattern board 414 in the second direction.

Further, wedge interfacer 410 can be at about a 5 degree angle from pattern board 414. Interacting with this angle, when pattern board 414 is driven along the second axis the distance between pattern board 414 and the flooring interfacer 412 can decrease. For example, when threaded rod 408 is rotated the wedge can be driven along the first axis towards base connector 404.

By way of another example, a method for creating mosaic flooring panels 100 can include providing a base connector 404, a wedge interfacer 410, a flooring interfacer 412, and a base structure 402, such as a main board. Further, a plurality of pieces 101 can be configured on base structure 402 and these pieces 101 can be solid wood pieces that can have adhesive applied on them. Further still, pattern board 414 can be located on base structure 402, can be located between wedge interfacer 410 and the plurality of pieces 101, and can be capable of traversing second axis, axis b.

The method can further include threading a threaded rod 408 of the flooring-wedge retainer system 306, such that wedge device 400 traverses a first axis, axis a, driving pattern board 414 to traverse a second axis, axis b, and thereby causing the plurality of pieces 101, that can have adhesive on them, to be forcibly compressed together wherein they can then be placed in a press, for example, a hot press.

Figure 5A:
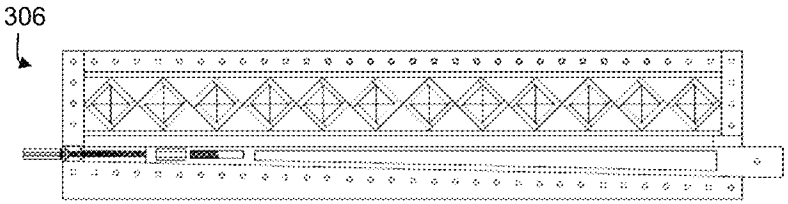
FIGS. 5A-C, 6A-C, and 7A-D illustratively depict various exemplary configurations of one or more wedge vice systems, in accordance with embodiments of the disclosure.
Figure 5C:
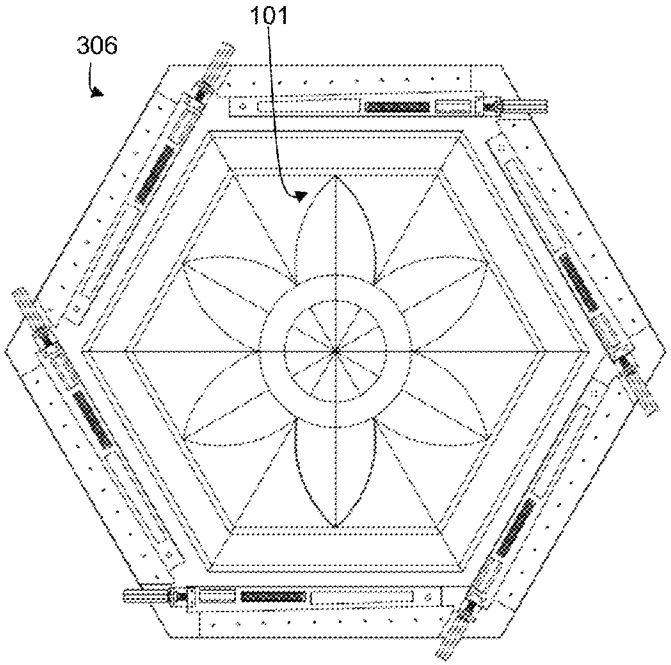
Figure 5B:
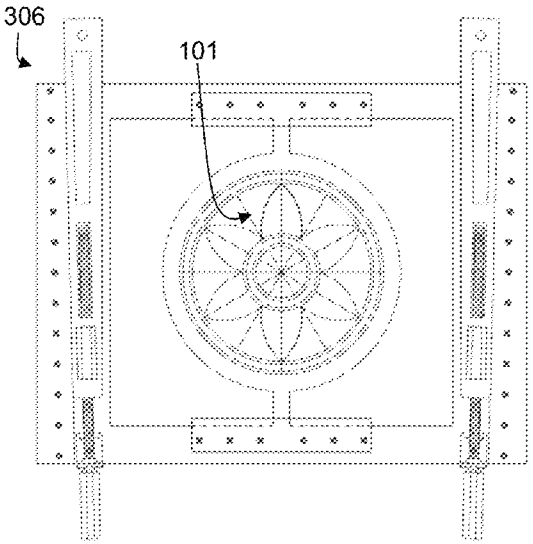

Referring to FIGS. 5A-5C, in exemplary embodiments, any plurality of wedge vices and/or flooring-wedge retainer system 306 can be used to construct a force that can be applied on the pieces 101 such that pieces 101 can be compressed, for example, into a single mosaic design. For example, a single wedge vice and/or flooring-wedge retainer system 306 can be used as shown in FIG. 5A, two wedge vices and/or flooring-wedge retainer system 306 can be used as shown in FIG. 5B, or a larger plurality of wedge vices and/or flooring-wedge retainer system 306 can be used as shown in FIG. 5C.

Figure 6A:
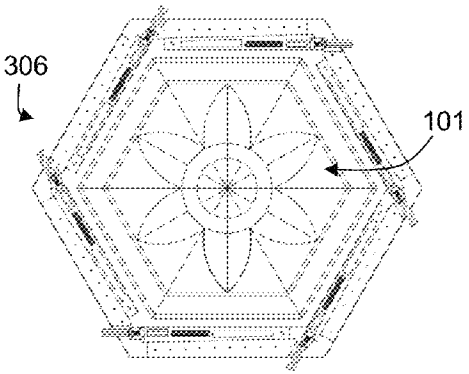
Figure 6C:
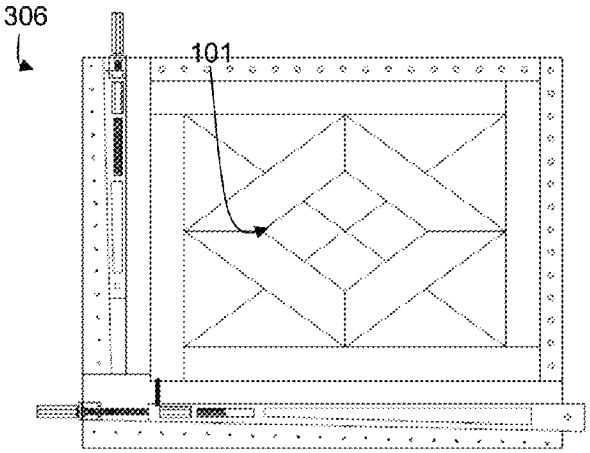
Figure 6B:
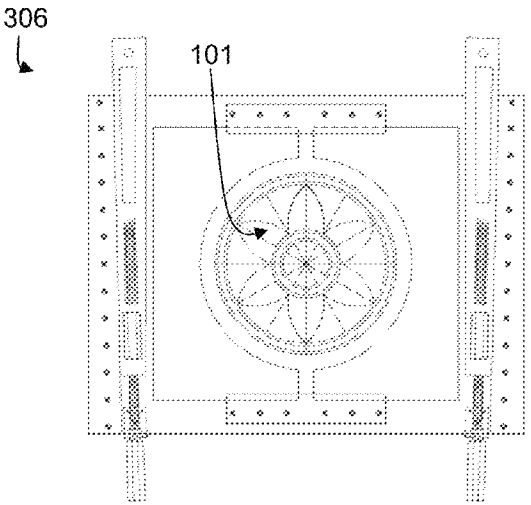
Figure 7B:
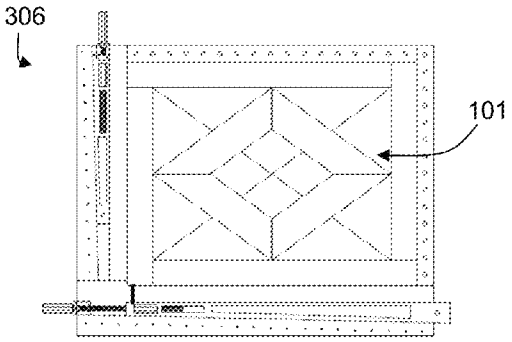
Figure 7D:
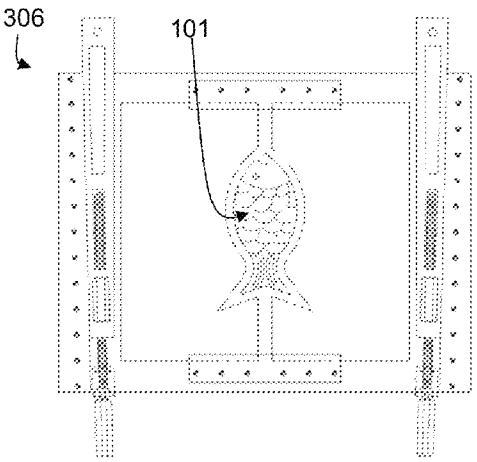
Figure 7A:
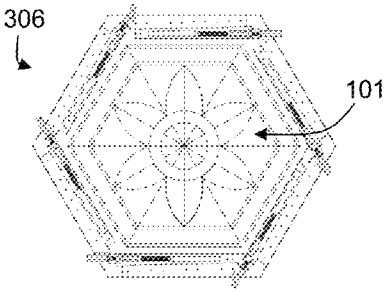
Figure 7C:
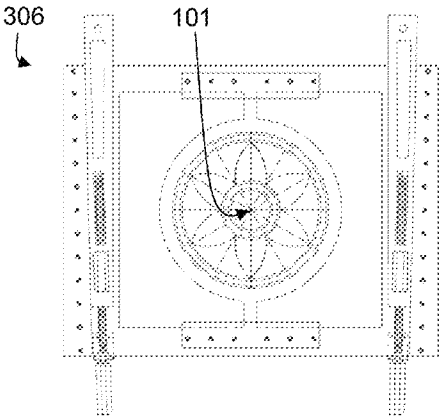

Referring to FIGS. 6A-6C, in exemplary embodiments, any number of wedge vices and/or flooring-wedge retainer system 306 can be located in any configuration to construct a force that can be applied on the pieces 101 such that pieces 101 can be compressed, for example, into a single mosaic design. For example, more than one wedge vices and/or flooring-wedge retainer system 306 can be configured in a geometric pattern, can be configured at an angle to another wedge vices and/or flooring-wedge retainer system 306, can be configured substantially in parallel with another, and/or can be in any other configuration capable of construct a force that can be applied on the pieces 101 such that pieces 101 can be compressed into a single mosaic design.

Figure 8C:
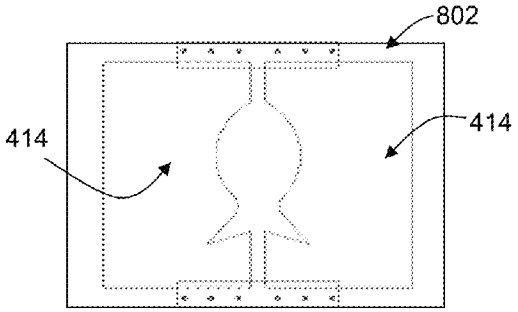
FIGS. 8A-8F illustratively depict using an exemplary shaped pattern board for construction of exemplary mosaic flooring panels, in accordance with embodiments of the disclosure.
Figure 8B:
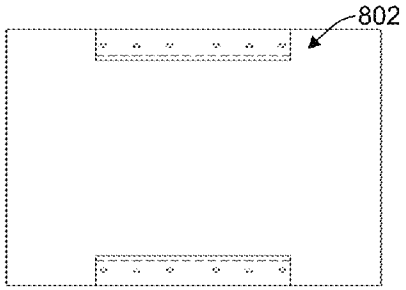
Figure 8A:
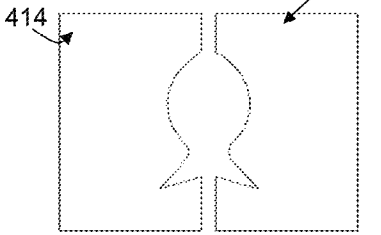
Figure 8F:
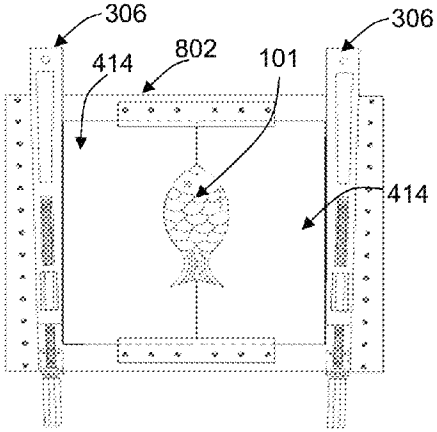
Figure 8E:
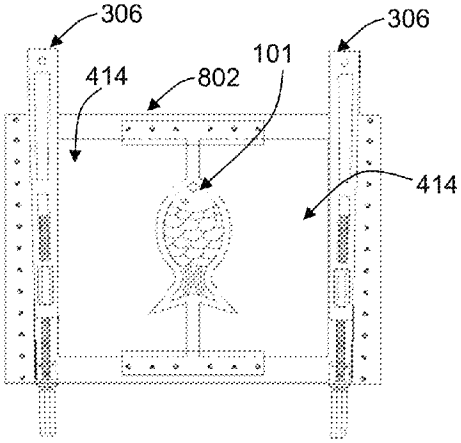
Figure 8D:
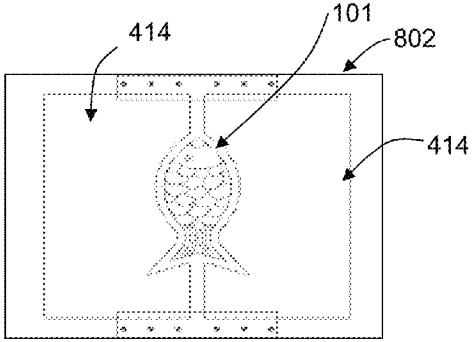

Referring to FIGS. 7A-7D, in exemplary embodiments, any number of wedge vices and/or flooring-wedge retainer system 306 can be located in any configuration to construct a mosaic, viewed from the top or bottom, having any shape such as, but not limited to, round, square, polygonal, squares, triangular, animal shaped, herringbone shaped, and/or any other shape. By way of example, as shown in FIG. 8A, at least one pattern board 414 can include a shape, such as an animal shape. Pattern board 414 can be placed on a main board 802, as shown in FIGS. 8B-8C, such that pieces 101 can be located on main board 802 and configured within a shape defined by at least one pattern board 414, as shown in FIG. 8D. With pieces 101 on the main board 802 and configured in the desired shape, wedge vices and/or flooring-wedge retainer system 306 can be placed on main board 802, as shown in FIG. 8E, and compressive force can be applied on pieces 101, as shown in FIG. 8F.

Figure 9A:
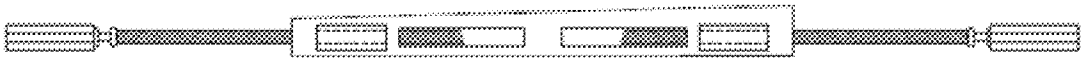
FIGS. 9A-9C illustratively depict various configurations of exemplary wedge vice systems, in accordance with embodiments of the disclosure.
Figure 9B:
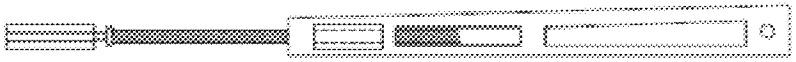
Figure 9C:
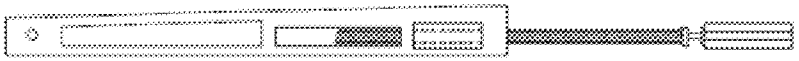

Referring to FIGS. 9A-9C, in exemplary embodiments, wedge vices and/or flooring-wedge retainer system 306 can include have various configurations. As shown in FIG. 9A, wedge vices and/or flooring-wedge retainer system 306 can include more than one user interface. Further, referring to FIGS. 9B and 9C, wedge vices and/or flooring-wedge retainer system 306 can include user interfaces located at various locations and/or positions.

Figure 10:
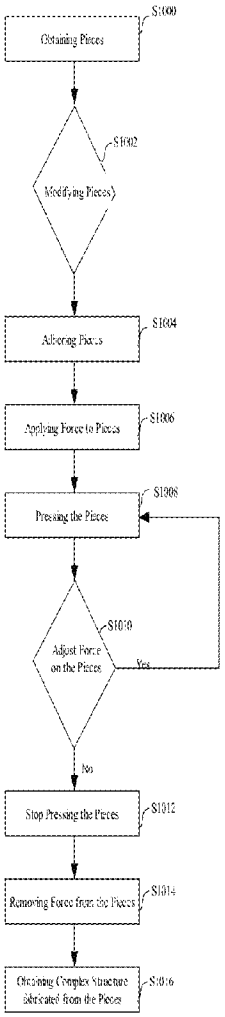
FIG. 10 is a flowchart illustrating a method for constructing more complex mosaic structures from at least one mosaic flooring panel, in accordance with embodiments of the disclosure.

Referring to FIG. 10, in exemplary embodiments, methods for constructing more complex mosaic structures from at least one mosaic flooring panels 100 constructed, for example, as described above, can include numerous steps such as, but not limited to, the steps of obtaining mosaic flooring panels 100, modifying the obtained mosaic flooring panels 100, patterning and adhesively affixing the mosaic flooring panels 100 into a more complex structure, applying force on the more complex structure, and pressing the more complex structure.

By way of example, referring to FIGS. 10 and 11A-11J, methods for constructing more complex mosaic structures, such as a baluster and/or column from at least one mosaic flooring panels 100 are illustratively depicted.

Referring to FIG. 10, at step 1000, at least one mosaic flooring panels 100 can be obtained. For example, referring to FIG. 11A, at least one mosaic flooring panels 100 can be obtained, for example, as described above, after being released from wedge vices and/or flooring-wedge retainer system 306.

Referring back to FIG. 10, at option step 1002, mosaic flooring panels 100 shape can be modified such that a more complex mosaic structure can be produced. For example, referring to FIG. 11B, lateral side 300 of mosaic flooring panel 100 can be modified by being angled. By way of example, these shape modifications can be done such that the mosaic flooring panels 100 can be combined to form a baluster and/or column. Of course other modifications are within the scope of the disclosure.

Figure 11A:
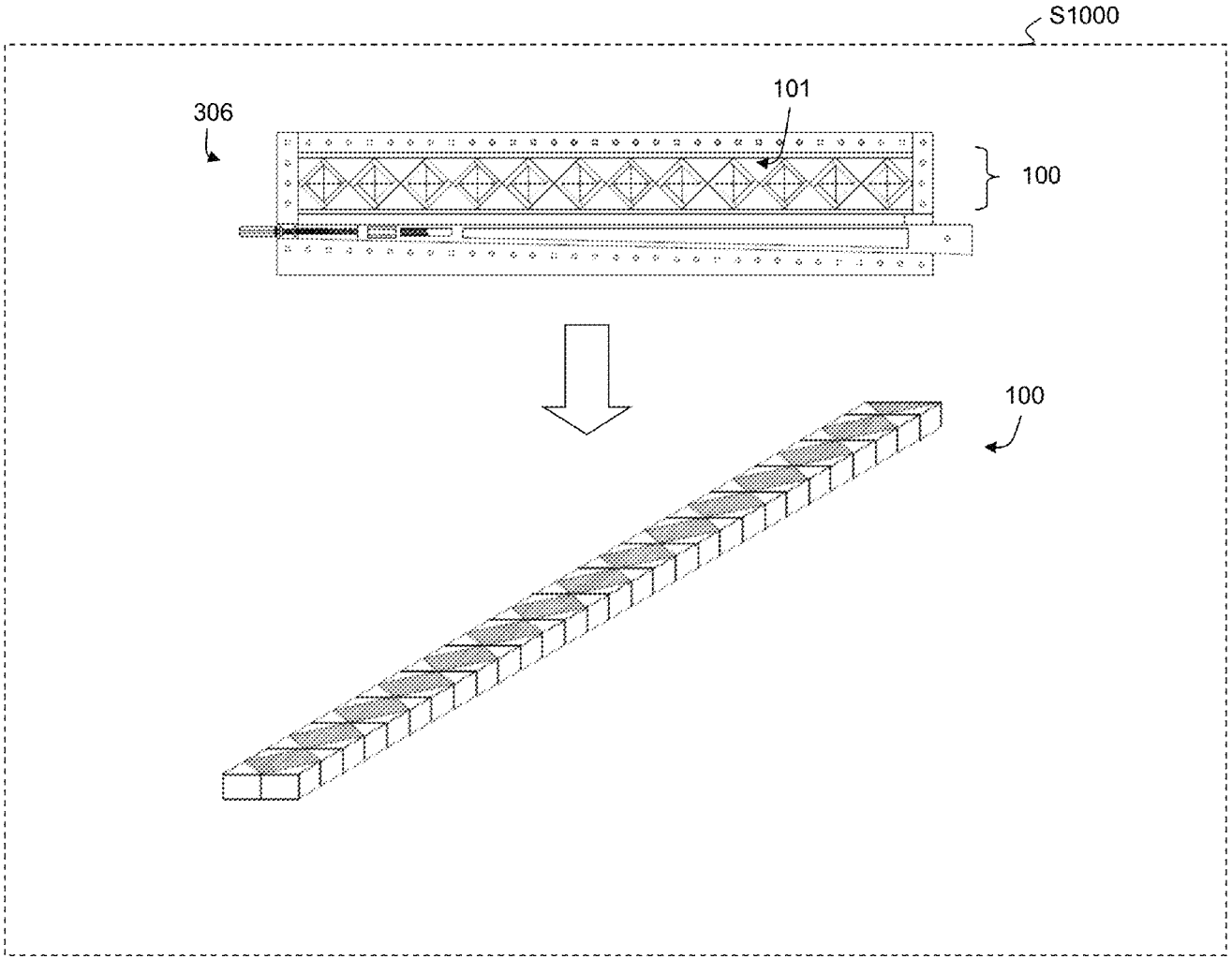
FIGS. 11A-11J illustratively depict various steps and/or variations thereof in the method for constructing more complex mosaic structures from at least one mosaic flooring panel, in accordance with embodiments of the disclosure.
Figure 11B:
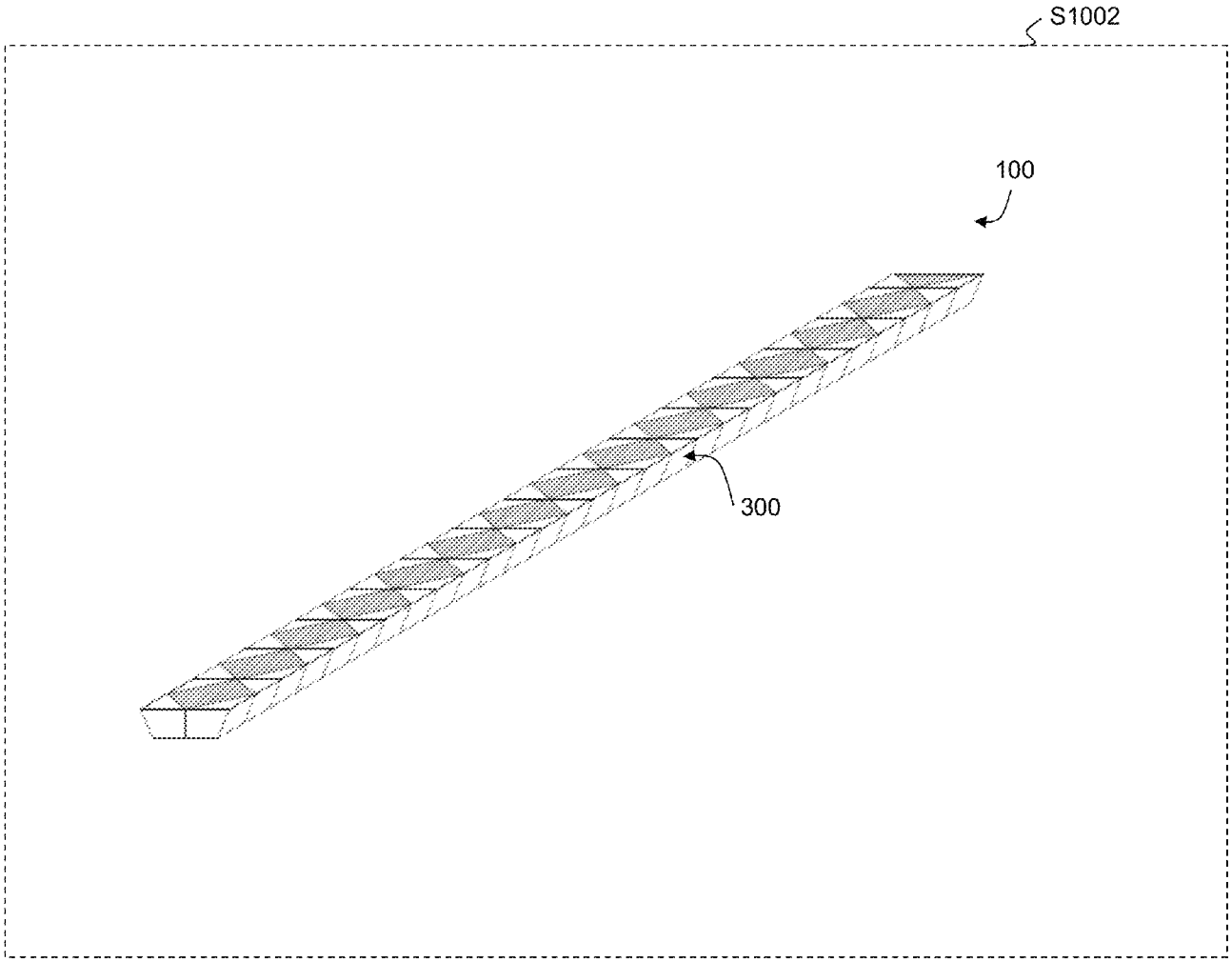
Figure 11C:
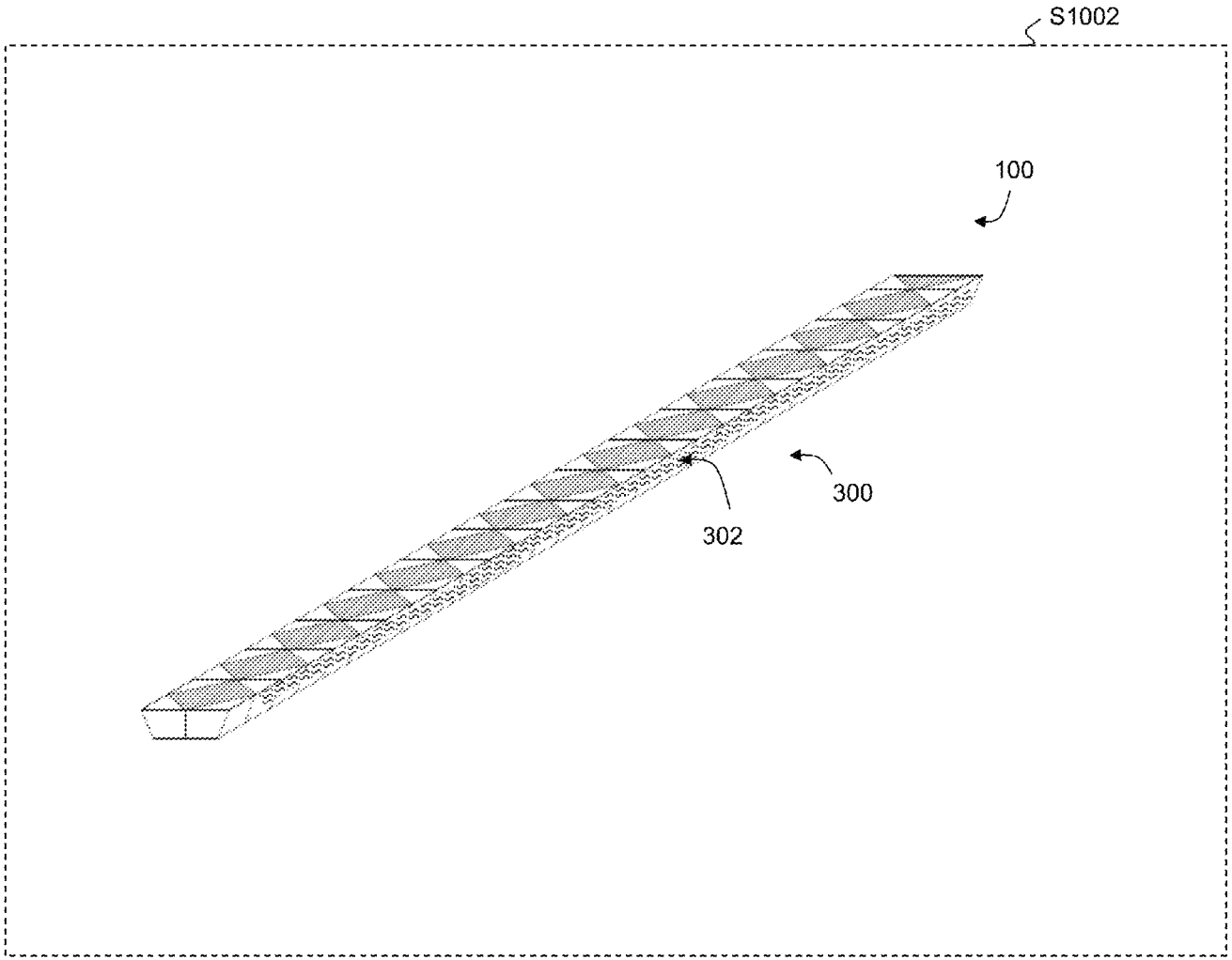
Figure 11D:
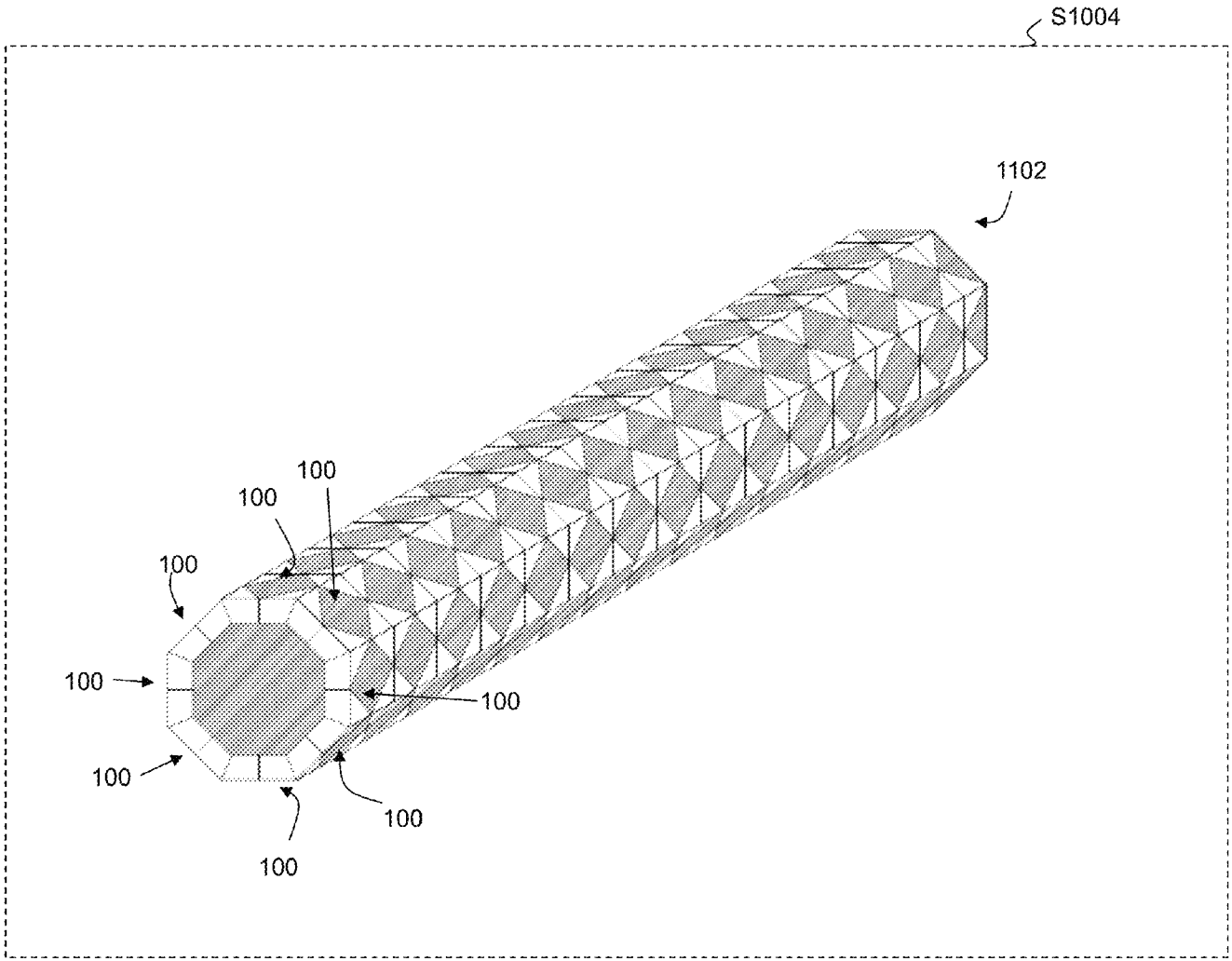

Referring back to FIG. 10, at step 1004, adhesive can be applied to at least some of at least one of the lateral sides 300 of mosaic flooring panels 100 forming a more complex structure. For example, referring to FIG. 11C, adhesive 302 can be applied on at least some of lateral sides 300 of mosaic flooring panel 100 that contact at least some of other lateral sides 300 of another mosaic flooring panel 100 forming more complex structure 1102, for example, as shown in FIG. 11D.

In some instances, adhesive 302 need not be applied to all lateral sides 300 of mosaic flooring panels 100 that contact other lateral sides 300 of other mosaic flooring panels 100. For example, if two mosaic flooring panels 100 are going to be adhered together on a lateral side than adhesive 302 can be applied on only one of the wood's lateral sides. In some instances, adhesive 302 need not be applied to all lateral sides 300 of each of mosaic flooring panels 100. For example, adhesive 302 may not be applied to the outermost lateral sides 300 that form the eternal edge of mosaic flooring panel 100.

It will be understood that adhesive can be applied to at least some of at least one of the lateral sides 300 of mosaic flooring panel 100. For ease, referring to FIG. 11C adhesive 302 is illustratively depicted on one lateral side 300 of a mosaic flooring panels 100. This is merely for ease and is in no way meant to be a limitation.

Referring back to FIG. 10, at step 1006, force can be applied on the more complex structure 1102 such that more complex structure 1102 can be compressed. This compressive force can result in a substantially single mosaic design. For example, force can be applied on the outermost lateral surface of the mosaic design compressing more complex structure 1102 substantially equally. Further, in exemplary embodiments, this force can be applied equally on the laterally surface of at least some of the more complex structure 1102. Further, at step 1008, wedge vices and/or flooring-wedge retainer system 306 housing and/or compressing more complex structure 1102 can then be placed into a machine press 308 and pressed.

By way of example, similarly described above, machine press 308 can be a hot press that heats wedge vices and/or flooring-wedge retainer system 306, more complex structure 1102, and/or adhesive 302 to about 75-200 degrees Celsius and/or, more specifically, about 100-130 degrees Celsius.

Figure 11E:
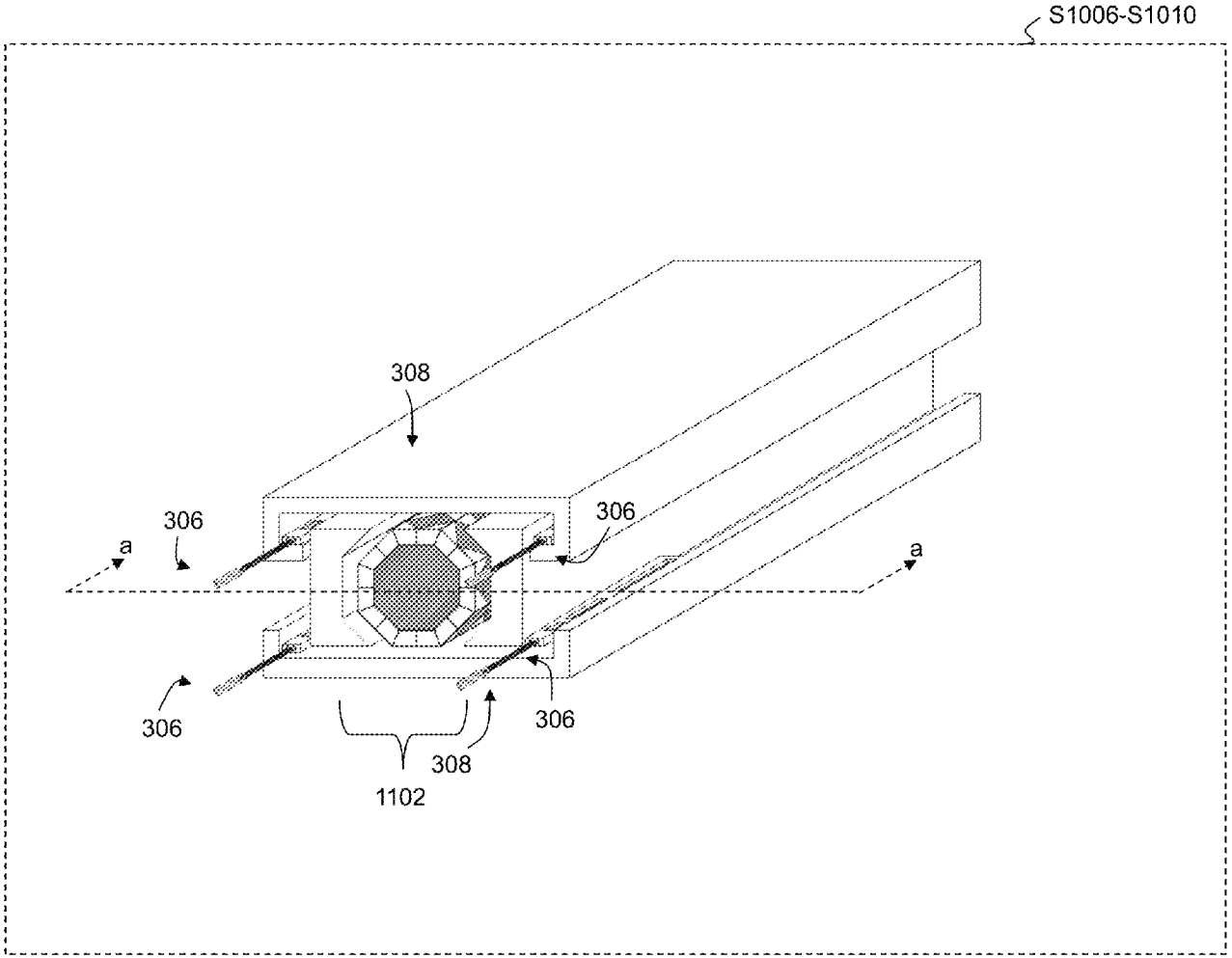
Figure 11F:
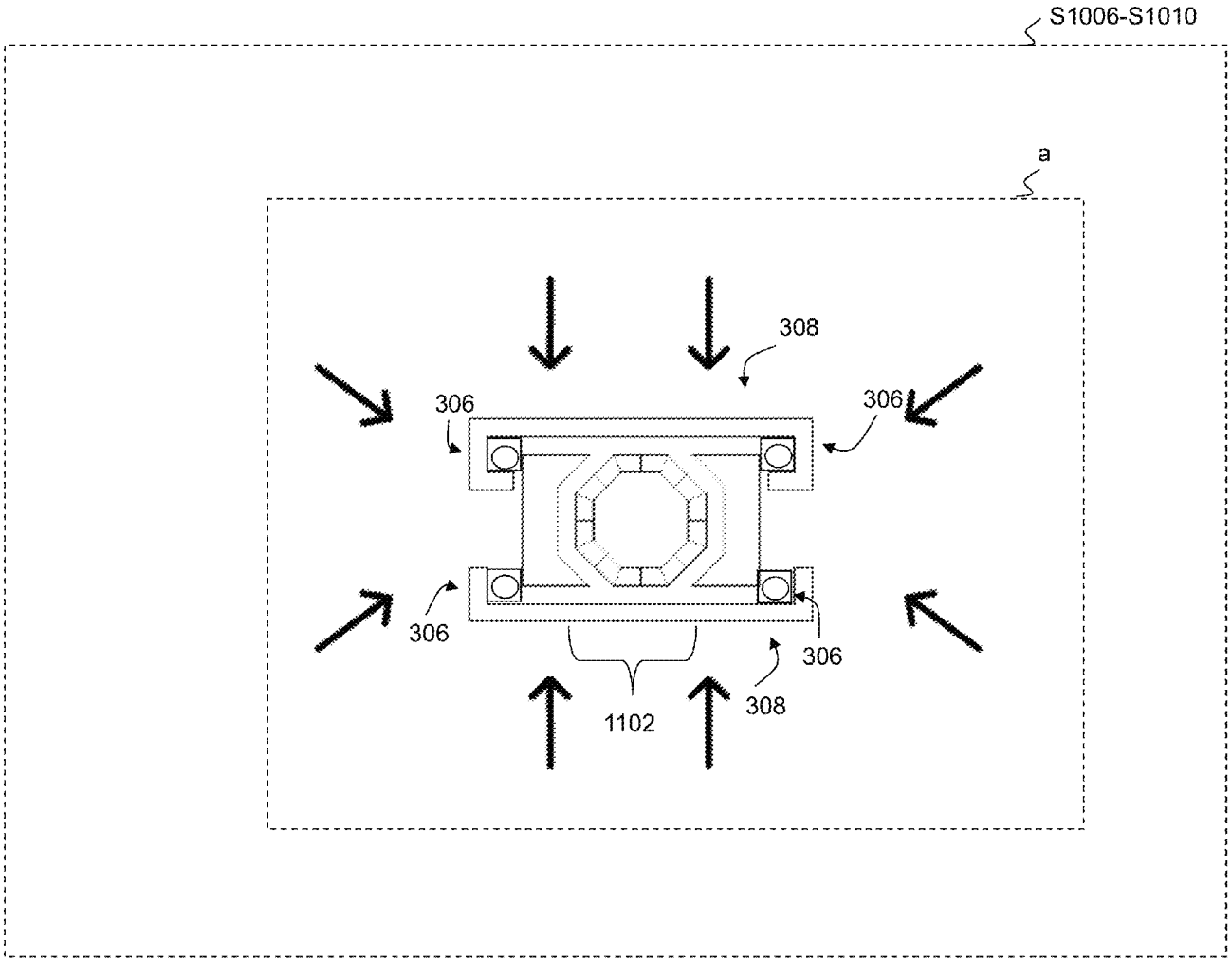
Figure 11G:
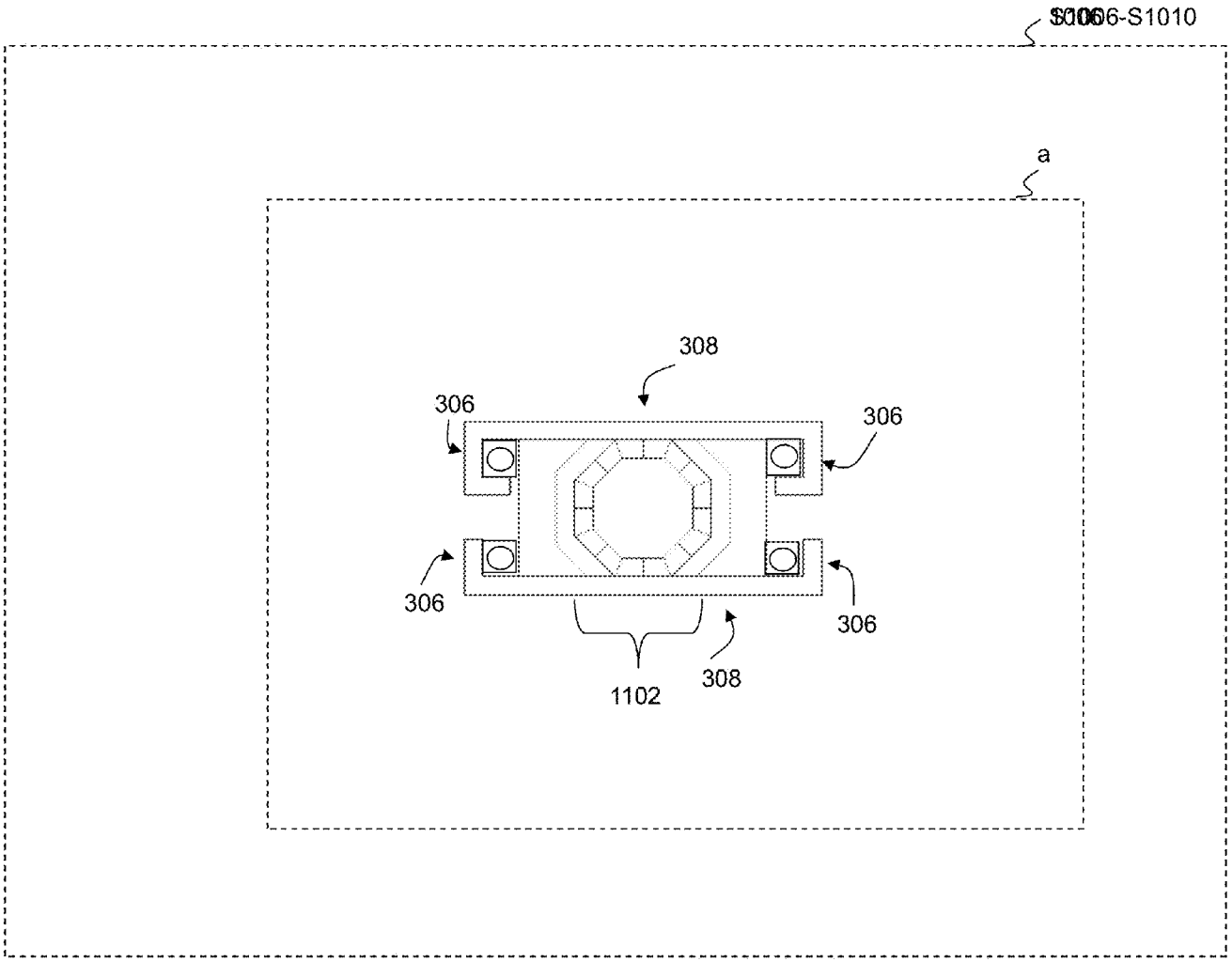
Figure 11H:
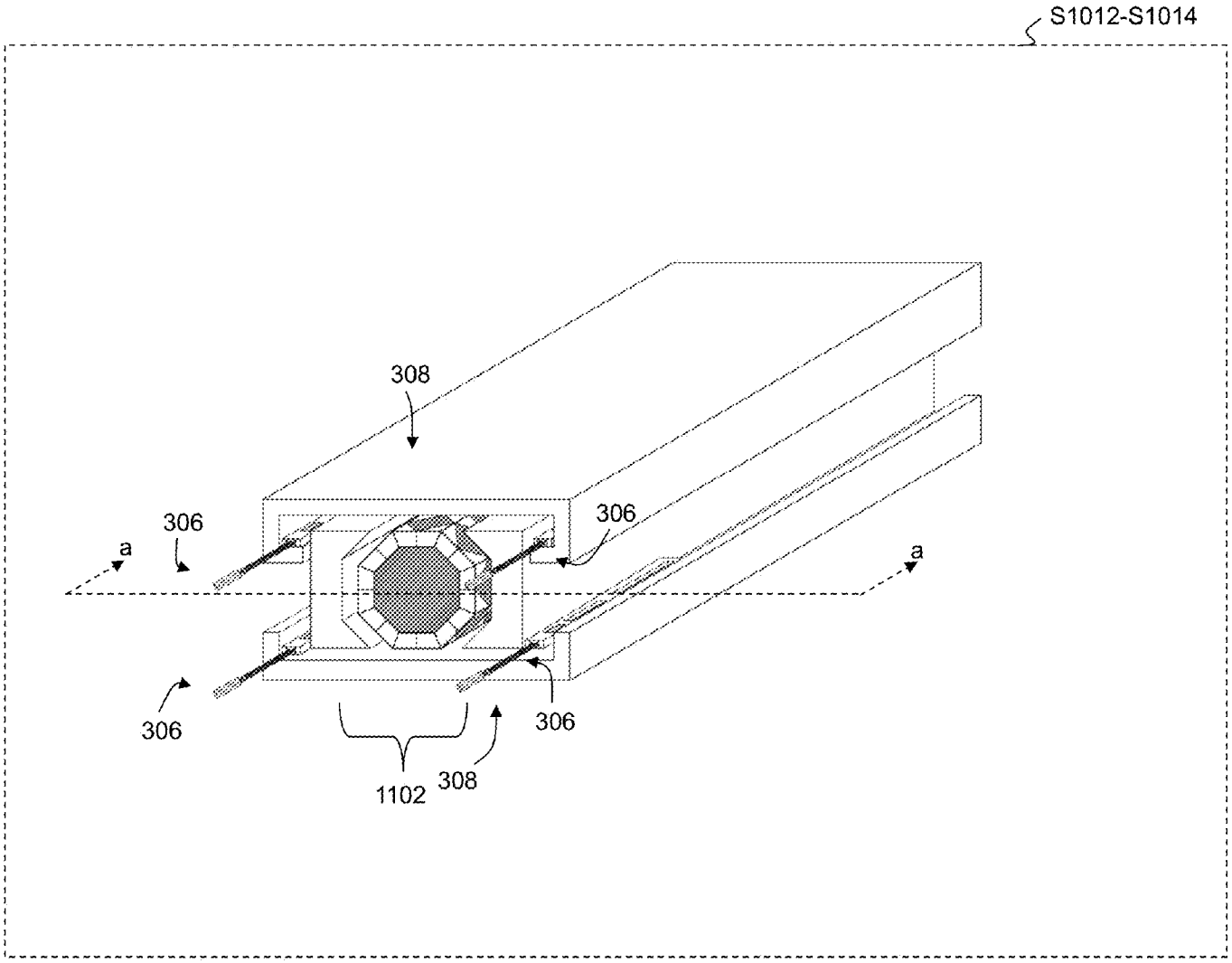
Figure 11I:
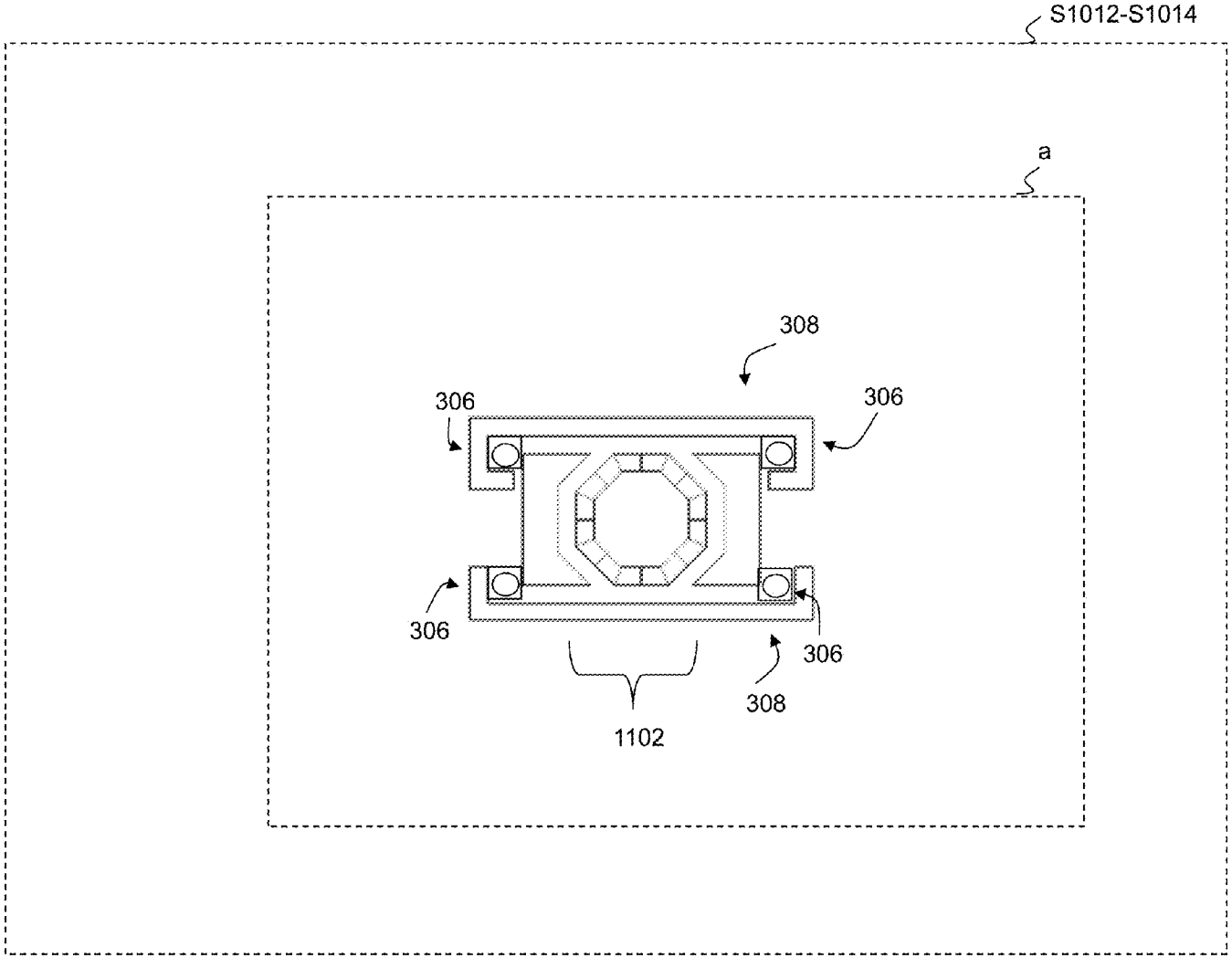
Figure 11J:
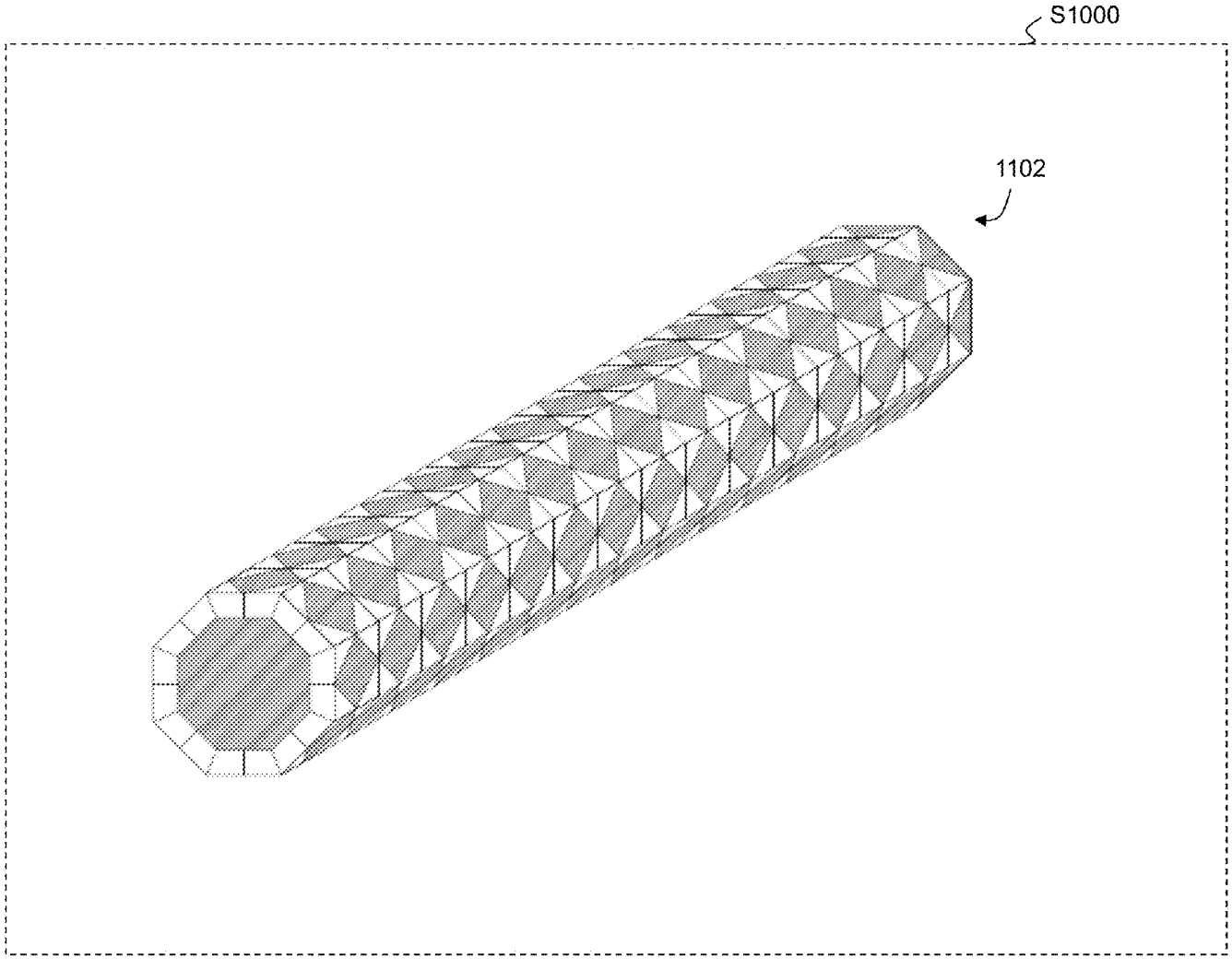

For example, referring to FIG. 11E-11G, wedge vices and/or flooring-wedge retainer system 306 that uses at least one wedge vice is illustratively depicted applying force on more complex structure 1102 such that more complex structure 1102 can be compressed. Further, wedge vices and/or flooring-wedge retainer system 306 housing and/or compressing more complex structure 1102 can be placed in machine press 308 and be pressed. As shown, wedge vices and/or flooring-wedge retainer system 306 and machine press 308 can function together.

Further, by way of example, similarly described above, machine press 308 can apply about 2-15 bars (about 29-218 pound per square inch) on wedge vices and/or flooring-wedge retainer system 306, more complex structure 1102, and/or adhesive 302 and/or, more specifically, can apply about 6 bars (about 87 pound per square inch) on wedge vices and/or flooring-wedge retainer system 306, more complex structure 1102, and/or adhesive 302.

Further still, similarly described above, in exemplary embodiments, with adhesive 302 applied, wedge vices and/or flooring-wedge retainer system 306 housing and/or more complex structure 1102 can be immediately placed into machine press 308 where it can be pressed and/or the temperature can be high enough to cause adhesive 302 to melt and/or cure. Also, in exemplary embodiments, with adhesive 302 applied, wedge vices and/or flooring-wedge retainer system 306 housing and/or compressing more complex structure 1102, after waiting a period of time, such as, about an hour, can be placed into machine press 308 where it can be pressed and/or the temperature can be high enough to cause adhesive 302 to melt and/or cure.

Referring back to FIG. 10, at decision step 1010, while under the press, the force applied by wedge vices and/or flooring-wedge retainer system 306 can be adjusted. That is, while under the press completely and/or with at least some of the pressing force removed, a user can interface with wedge vices and/or flooring-wedge retainer system 306 to adjust the force compressing more complex structure 1102. This force adjusting can be used to create more complex mosaic structures such as, for example, balusters, columns, and other more complex mosaic structures that can be, for example, constructed from a plurality of more complex mosaic structures 1102 combined together.

At step 1012, the pressing of the more complex structure 1102 can be completed; at step 1014, force applied on the more complex structure 1102 from wedge vices and/or flooring-wedge retainer system 306 and/or machine press 308 that was compressing the more complex structure 1102 can be released; and, at step 1016, more complex structure 1102 can be obtained. For example, referring to FIG. 11H-11I, wedge vices and/or flooring-wedge retainer system 306 and/or machine press 308 housing and/or compressing the more complex structure 1102 is illustrated with the force applied on it lessened and, referring to FIG. 11J, more complex structure 1102 is illustrated after being removed from and/or machine press 308.

It will be understood that any of the steps described herein can be further added to, removed, occur in a different sequential order, be combined, and/or separated without deviating from the scope of the invention. For ease, at times, these steps are described as occurring sequentially and/or separately. This is merely for ease and is in no way meant to be a limitation.

Figure 12A:
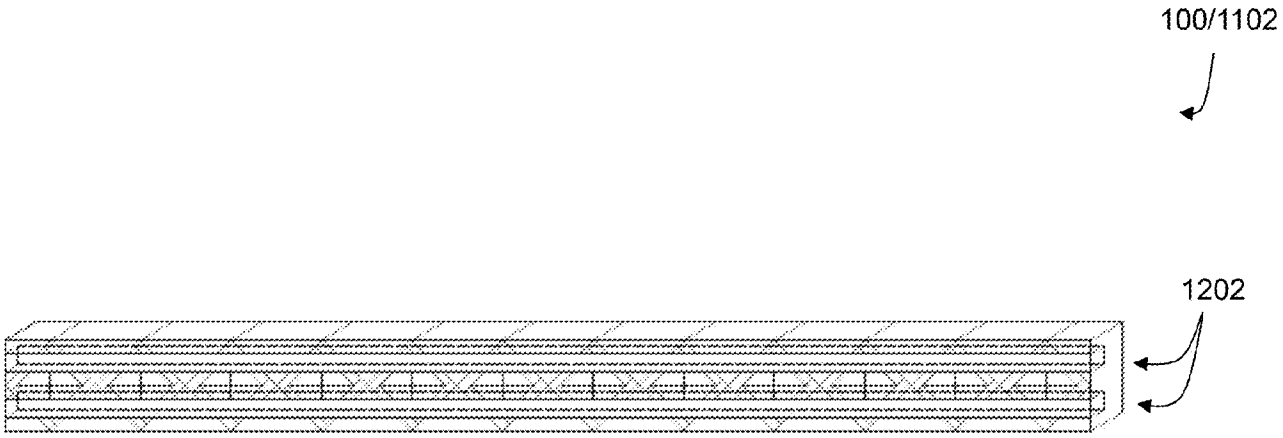
FIGS. 12A-12B illustratively depict reinforcing members for use in mosaic flooring panel and/or more complex mosaic structures, in accordance with embodiments of the disclosure.
Figure 12B:
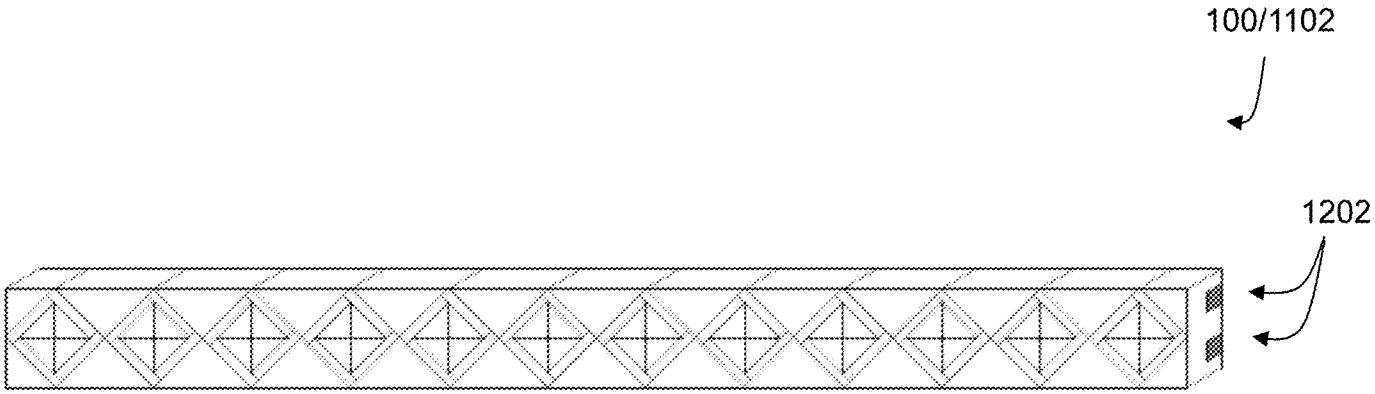

Referring to FIGS. 12A-12B, in exemplary embodiments, mosaic flooring panel 100 and/or more complex mosaic structure 1102 can be constructed such that are substantially strong, stabile, and/or sturdy across a substantially long length. To increase the strength, stability, and/or sturdiness of mosaic flooring panel 100 and/or more complex mosaic structure 1102 a volume of mosaic flooring panel 100 and/or more complex mosaic structure 1102 can be removed and/or replaced with another supporting material 1202. For example, on the non surface showing side of mosaic flooring panel 100 and/or more complex mosaic structure 1102 at least one supporting material 1202 can be inserted and/or affixed. By way of example, at least one plank of solid wood can be inserted along at least some of the length of mosaic flooring panel 100 and/or more complex mosaic structure 1102 and/or adhesive can be applied to increase strength, stability, and sturdiness of mosaic flooring panel 100 and/or more complex mosaic structure 1102.

It will be understood that any of the steps described can be rearranged, separated, and/or combined without deviated from the scope of the invention. For ease, steps are, at times, presented sequentially. This is merely for ease and is in no way meant to be a limitation.

Further, it will be understood that any of the elements and/or exemplary embodiments of the invention described can be rearranged, separated, and/or combined without deviated from the scope of the invention. For ease, various elements are described, at times, separately. This is merely for ease and is in no way meant to be a limitation.

While the various steps, elements, and/or exemplary embodiments of the invention have been outlined above, it is evident that many alternatives, modifications and variations will be apparent to those skilled in the art. The various steps, elements, and/or exemplary embodiments of the invention, as set forth above, are intended to be illustrative, not limiting. Various changes may be made without departing from the spirit and scope of the invention. Accordingly, the spirit and scope of the present invention is to be construed broadly and limited only by the appended claims and not by the foregoing specification.

What is claimed is:

1. A wedge style vice for creating flooring panels comprising:

a flooring-wedge retainer device comprising: (a) a base structure, (b) a base connector, (c) a wedge interfacer, (d) a flooring interfacer, and (e) a pattern board capable of translating in a first direction, wherein the base connector, the wedge interfacer, and the flooring interfacer are immovably affixed to the base structure of the flooring-wedge retainer;

a wedge device comprising: (a) a base connector region, (b) a threaded rod, and (c) a wedge body capable of translating in the first direction and a second direction, the wedge body comprising a first side contacting the wedge interfacer and a second side contacting the pattern board, the second side being parallel to the pattern board and the flooring interfacer and the first side being at an angle to the pattern board and the flooring interfacer;

the wedge device being located between the wedge interfacer and the pattern board such that the pattern board and the flooring interfacer are parallel to each other and the wedge interfacer are at an angle to both the flooring interfacer and the pattern board; and wherein the wedge body translates in at least one of the first direction and the second direction such that translating the wedge body drives the pattern board in a first direction that is parallel to the flooring interfacer, thereby forcibly holding together a plurality of flooring pieces.

2. The wedge style vice of claim 1, wherein the pattern board is a wood slat.

3. The wedge style vice of claim 1, wherein the pattern board is an ornamental design.

4. The wedge style vice of claim 1, wherein the wedge interfacer is at about a 5 degree angle from the pattern board.

5. The wedge style vice of claim 1, wherein driving the pattern board in the first direction reduces the distance between the pattern board and the flooring interfacer.

6. The wedge style vice of claim 1, when the threaded rod of the wedge device is rotated the wedge body translates at least one of away from and towards the base connector.

7. The wedge style vice of claim 6, wherein the threaded rod is adapted for rotation by a mechanical drill.

8. The wedge style vice of claim 1, wherein the wedge device is constructed of metal and the pattern board is constructed of wood slat.

9. The wedge style vice of claim 1, wherein the pattern board comprises a shaped structure.

10. The wedge style vice of claim 1, comprising a plurality of wedge devices and a plurality of pattern boards in at least one flooring-wedge retainer and at least one hot press.

* * * * *